US010608357B2

(12) United States Patent
Kee Mew et al.

(10) Patent No.: US 10,608,357 B2
(45) Date of Patent: Mar. 31, 2020

(54) ELECTRICAL CONNECTION DEVICE

(71) Applicant: Molex, LLC, Lisle, IL (US)

(72) Inventors: Jonathan Ah-Fat Kee Mew, Singapore (SG); Jerry Dean Kachlic, Glen Ellyn, IL (US); Chih-Sheng Yu, Taipei (TW); Yueh-Ting Chiang, Taoyuan (TW); Lin Tong, Shijie Town (CN); Xing-Qiang He, Shijie Town (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/141,148

(22) Filed: Sep. 25, 2018

(65) Prior Publication Data

US 2019/0097335 A1 Mar. 28, 2019

(30) Foreign Application Priority Data

Sep. 25, 2017 (CN) ..... 2017 1 0875400
Sep. 14, 2018 (CN) ..... 2018 1 1071911

(51) Int. Cl.
*H01R 12/71* (2011.01)
*H01R 12/62* (2011.01)
(Continued)

(52) U.S. Cl.
CPC ..... *H01R 12/716* (2013.01); *H01R 12/58* (2013.01); *H01R 12/592* (2013.01); *H01R 12/62* (2013.01);
(Continued)

(58) Field of Classification Search
CPC ..... H01R 12/724
(Continued)

(56) References Cited

U.S. PATENT DOCUMENTS 4,861,272 A * 8/1989 Clark ..... H01R 13/658 439/79
5,194,010 A * 3/1993 Dambach ..... H01R 12/57 439/499
(Continued)

FOREIGN PATENT DOCUMENTS

CN 101414032 A 4/2009
CN 106469863 A 3/2017
(Continued)

*Primary Examiner* — Neil Abrams
(74) *Attorney, Agent, or Firm* — Molex, LLC

(57) ABSTRACT

The present disclosure relates to an electrical connection apparatus provided on a substrate, comprising a base, a flexible circuit board, two connectors, and a fixing member. The flexible circuit board has a mating portion with a plurality of soldering pads; a mounting portion with a plurality of conductive blocks; and a plurality of conductive traces connecting the plurality of pads and the plurality of conductive blocks. The two connectors each have an insulative housing and a terminal. Each terminal has a soldering portion connected to the soldering pad. The substrate has a plurality of soldering pads connecting the conductive blocks. The fixing member fixes the base to the substrate. The present disclosure utilizes a ground layer of the flexible circuit board to reduce a signal crosstalk between the conductive traces, and utilizes the conductive blocks to connect the flexible circuit board and the substrate to improve coplanarity.

19 Claims, 19 Drawing Sheets

(51) Int. Cl.

| | |
|---|---|
| ***H01R 13/717*** | (2006.01) |
| ***H01R 13/506*** | (2006.01) |
| ***H01R 12/58*** | (2011.01) |
| ***H01R 12/70*** | (2011.01) |
| ***H01R 12/59*** | (2011.01) |

(52) U.S. Cl.
CPC ..... *H01R 12/7064* (2013.01); *H01R 13/506* (2013.01); *H01R 13/7172* (2013.01); *H01R 13/7175* (2013.01)

(58) Field of Classification Search
USPC ..... 439/79, 541.5
See application file for complete search history.

(56) References Cited

U.S. PATENT DOCUMENTS 6,280,205 B1 * 8/2001 Murowaki ..... H05K 1/141 439/79
6,318,909 B1 11/2001 Giboney et al.
6,617,518 B2 * 9/2003 Ames ..... H01R 12/592 174/254
6,719,574 B2 * 4/2004 Grek ..... H05K 1/141 439/79
6,976,854 B2 * 12/2005 Stockhaus ..... G02B 6/3897 439/79
7,179,091 B2 * 2/2007 Mongold ..... H01R 12/721 439/67
7,249,897 B2 * 7/2007 Aruga ..... G02B 6/4201 385/14
7,427,213 B2 * 9/2008 Kondou ..... H01R 13/6273 439/541.5
7,467,953 B2 * 12/2008 Kuo ..... H01R 12/592 439/484
9,077,123 B2 * 7/2015 Ma ..... H01R 12/716
9,553,384 B2 * 1/2017 Asanuma ..... H01R 12/778
2019/0097335 A1 * 3/2019 Kee Mew ..... H01R 12/716

FOREIGN PATENT DOCUMENTS

TW I580118 B 4/2017
TW I625012 B 5/2018

* cited by examiner

ELECTRICAL CONNECTION DEVICE

RELATED APPLICATIONS

This application claims priority to Chinese Application No. 201710875400.0, filed Sep. 25, 2017, and Chinese Application No. 201811071911.8, filed Sep. 14, 2018, both of which are incorporated herein by reference in their entirety.

TECHNICAL FIELD

The present disclosure relates to an electrical connection device, especially to an electrical connection device with a flexible circuit board.

BACKGROUND ART

An electrical connection device is widely used in various electronic information products and is used to connect different transmission ends to transmit signals. Due to the amount of data transmission is increasing and complicated, the electrical connection device needs to increase a transmission frequency and have more densely distributed transmission terminals to meet demands for a large amount of data transmission. However, a high frequency transmission is prone to face a problem of crosstalk due to the coupled signals between dense terminals, moreover, when the electrical connection device is engaged with an external transmission end (such as a motherboard) by a technology such as a surface-mount technology (SMT), most of the terminals are easy to produce a problem of poor coplanarity.

Chinese patent application No. CN2015105148029 (Chinese patent publication No. CN106469863A) discloses an electrical connection device which utilizes a plurality of signal terminals in a receptacle unit to connect the different transmission ends, and utilizes a grounding terminal interposed between the plurality of signal terminals to reduce a problem of a crosstalk between the signal terminals. Only when the electrical connection device has a plurality of receptacle units, the plurality of receptacle units are stacked with each other, the receptacle unit which is farther from the transmission end to be connected will require longer signal terminals to transmit the signals, for the longer signal terminals, an effect of reducing crosstalk by the grounding terminal interposed between the longer signal terminals is limited.

Additionally, an engagement of the terminal with a circuit board in the Chinese patent application is by that a pin-shaped tail portion of the terminal is inserted into a via on the circuit board, and the via would break the circuit board and reduce flexibility and freedom degree of a design of the circuit board. When the engagement of the terminals with the circuit board is replaced by an engagement through a technology such as the surface-mount technology to avoid the vias of the circuit board, the plurality of terminals will be easy to produce the problem of coplanarity, which is difficult to make the plurality of terminals coplanar and be reliably connected to the circuit board on correct positions.

The description in background as above merely is used to provide a background art, and it does not admit that the description on the background as above discloses the purpose of the present disclosure, and do not constitute a prior art of the present disclosure, and any description in background as above shall not be acted as any part of the present disclosure.

SUMMARY

An embodiment of the present disclosure is to provide an electrical connection device. The electrical connection device is provided on a substrate, the electrical connection device comprises a base, a flexible circuit board, a first connector, a second connector and a fixing member. The base comprises a first supporting portion and a second supporting portion. The flexible circuit board comprises a first mating portion, a second mating portion, a mounting portion, a plurality of first conductive traces and a plurality of first conductive traces. The first mating portion is configured to be supported by the first supporting portion in a first direction. The first mating portion has a first mating surface. A plurality of first soldering pads are provided on the first mating surface. The second mating portion is configured to be supported by the first supporting portion in the first direction. The second mating portion has a second mating surface. A plurality of second soldering pads are provided on the second mating surface. The mounting portion is configured to be supported by the second supporting portion in a second direction. The first direction is different from the second direction. The mounting portion has a mounting surface. A plurality of first conductive blocks and a plurality of second conductive blocks are provided on the mounting surface. The plurality of first conductive traces connect the plurality of first soldering pads and the plurality of first conductive blocks. The plurality of second conductive traces connect the plurality of second soldering pads and the plurality of second conductive blocks. The first connector is engaged with the first mating portion along the first direction. The first connector comprises a first insulative housing and a plurality of first terminals. The plurality of first terminals are fixed to the first insulative housing. Each first terminal comprises a first contacting portion and a first soldering portion. The first soldering portion is connected to the first soldering pad. The second connector is engaged with the second mating portion along the first direction. The second connector comprises a second insulative housing and a plurality of second terminals. The plurality of second terminals are fixed to the second insulative housing. Each second terminal comprises a second contacting portion and a second soldering portion. The second soldering portion is connected to the second soldering pad. The fixing member fixes the base on the substrate.

In some embodiments, the electrical connection device further comprises a cover. The cover is engaged with the base along the first direction. The cover is defined with at least one opening to expose the first contacting portions and the second contacting portions. The fixing member is configured to fix an assembly of the base and the cover.

In some embodiments, the substrate has a plurality of third soldering pads and a plurality of fourth soldering pads, the plurality of third soldering pads connect with the plurality of first conductive blocks, the plurality of fourth soldering pads connect with the plurality of second conductive blocks.

In some embodiments, the base further comprises at least one second protruding post extending along the second direction.

In some embodiments, the base further comprises a first inserting hole. The cover further comprises a second inserting hole. The substrate further comprises two third inserting holes. Two end portions of the fixing member respectively pass through the first inserting hole and the second inserting hole and are respectively inserted into and fixed to the two third inserting holes.

In some embodiments, the at least one opening comprises a first opening and a second opening. The first opening exposes the first contacting portions. The second opening exposes the second contacting portions.

In some embodiments, the base further comprises a protruding block. The cover further comprises a latching portion. The latching portion is defined with a latching opening. The protruding block is latched and fixed to the latching opening.

In some embodiments, the base further comprises a base body. The base body, the first supporting portion and the second supporting portion are integrally formed.

In some embodiments, the base further comprises a base body. The first supporting portion and the second supporting portion are independent from the base body.

In some embodiments, the base body further comprises at least one first protruding post. The at least one first protruding post extends along the first direction. The first supporting portion further comprises at least one first through hole. The at least one first through hole is configured to position the at least one first protruding post therein.

In some embodiments, the base body further comprises at least one second protruding post. The at least one second protruding post extends along the second direction. The second supporting portion further comprises at least one second through hole. The at least one second through hole is configured to position the at least one second protruding post therein.

In some embodiments, the first supporting portion is independent from the second supporting portion.

In some embodiments, the first supporting portion and the second supporting portion are integrally formed.

In some embodiments, the flexible circuit board further comprises a connecting portion connecting the first mating portion and the mounting portion, the first mating portion and the second mating portion are positioned at a first end of the flexible circuit board, the mounting portion is positioned at a second end of the flexible circuit board opposite to the first end, and the flexible circuit board surrounds and covers the base by the connecting portion.

In some embodiments, the first mating portion and the second mating portion of the flexible circuit board are positioned at a first end of the flexible circuit board, the mounting portion is positioned at a second end of the flexible circuit board opposite to the first end, the mounting portion is firstly connected to the second mating portion and then connected to the first mating portion, and the flexible circuit board is a L-shape viewed from side.

In some embodiments, the flexible circuit board further comprises a connecting portion connecting the first mating portion and the mounting portion, the first mating portion is positioned at a first end of the flexible circuit board, the second mating portion is positioned a second end of the flexible circuit board opposite to the first end, the mounting portion is positioned between the first mating portion and the second mating portion, and the flexible circuit board surrounds and covers the base by the connecting portion.

In some embodiments, the flexible circuit board further comprises a light pipe to guide a light emitted from a LED element mounted on the flexible circuit board, the cover further comprises a light hole, the light pipe passes through the light hole to expose.

In some embodiments, the base further comprises a base body. The base body is arranged along the first direction with the first supporting portion, and is arranged along the second direction with the second supporting portion. The base body comprises a first hook and a second hook. The first hook is configured to latch either the first supporting portion of the base or the flexible circuit board. The second hook is configured to latch either the second supporting portion of the base or the flexible circuit board.

In some embodiments, the first supporting portion and the second supporting portion are independent from the base body.

In some embodiments, the first supporting portion is independent from the second supporting portion.

In some embodiments, the first supporting portion and the second supporting portion are integrally formed.

In some embodiments, the electrical connection device further comprises a first adhesion layer and a second adhesion layer. The first adhesion layer is configured to adhere the first mating portion and the second mating portion of the flexible circuit board to the first supporting portion. The second adhesion layer is configured to adhere the mounting portion of the flexible circuit board to the second supporting portion.

In some embodiments, each of the first adhesion layer and the second adhesion layer comprises an adhesive layer.

In some embodiments, the plurality of first conductive blocks each comprise a solder ball, and the plurality of second conductive blocks each comprise a solder ball.

In some embodiments, the base body further comprises at least one first protruding post: and at least one second protruding post. The at least one first protruding post extends along the first direction. The at least one second protruding post extends along the second direction. The first supporting portion of the base further comprises at least one first through hole. The at least one first through hole is configured to position the at least one first protruding post therein. The second supporting portion of the base further comprises at least one second through hole. The at least one second through hole is configured to position the at least one second protruding post therein.

In some embodiments, the two second protruding posts each comprise a first body portion and a second body portion. The first body portion is configured to form a gap between the substrate and the mounting portion. The first body portion comprises a shoulder portion. The shoulder portion is configured to abut against the substrate. The second body portion is provided on the first body portion and exposes the shoulder portion of the first body portion, and is configured to be positioned in a through hole of the substrate.

In some embodiments, the first direction is perpendicular to the second direction, the first mating portions and the second mating portions are arranged along the second direction.

In an embodiment of the present disclosure, the terminals of the connectors of the electrical connection device are not directly connected with the substrate, but are connected with the substrate through the mating portions, the conductive traces and the mounting portion of the flexible circuit board. Compared with a conventional method that a grounding terminal is utilized to reduce a crosstalk between signal terminals, in the embodiment of the present disclosure, because an inherent grounding layer in the flexible circuit board can provide a better ground reference and shielding to absorb an interference such as an electromagnetic wave with a wider range emitted from the conductive traces when transmitting signals, thus the crosstalk between the conductive traces can be better reduced. Additionally, an effect of utilizing the flexible circuit board to reduce the crosstalk is not affected by the number of stacks of the connectors, thus the design of the electrical connection device can be more flexible, for example, and more connectors can be further included.

In an embodiment of the present disclosure, the flexible circuit board of the electrical connection device is connected with the substrate through the plurality of conductive blocks. Compared with a conventional method that terminals is directly connected with the circuit board, in the embodiment, the plurality of conductive blocks can provide the better coplanarity when connected to the substrate by a technology such as the surface-mount technology, so that the plurality of conductive blocks can be reliably mounted on correct positions of the substrate.

In an embodiment of the present disclosure, the base, the cover and the substrate of the electrical connection device are fixed by a fixing member to strengthen the fixing of the assembly.

The above contents has widely summarized technical features and advantages of the present disclosure, and the present disclosure described in detail below is to obtain a better understanding. Other technical features and advantages that constitute the subject matter of the appended claims of the present disclosure will be described below. One skilled in the art should understand that the same objects as the present disclosure can be achieved with considerable ease by using the concept and specific embodiments disclosed below to modify or design other structures or processes. One skilled in the art should also understand that these equivalent configuration can not depart from the spirit and scope of the present disclosure as defined by the appended claims.

BRIEF DESCRIPTION OF THE DRAWINGS

Various aspects of the disclosed content of the present disclosure will be best understood by the following detailed description in combination with the accompanying figures. It is noted that according to industrial standard implementation, the features are not drawn to scale. Actually for clarity of discussion, sizes of the various features can be arbitrarily enlarged or reduced.

DETAILED DESCRIPTION OF THE PREFERRED EMBODIMENTS

Figure 1:
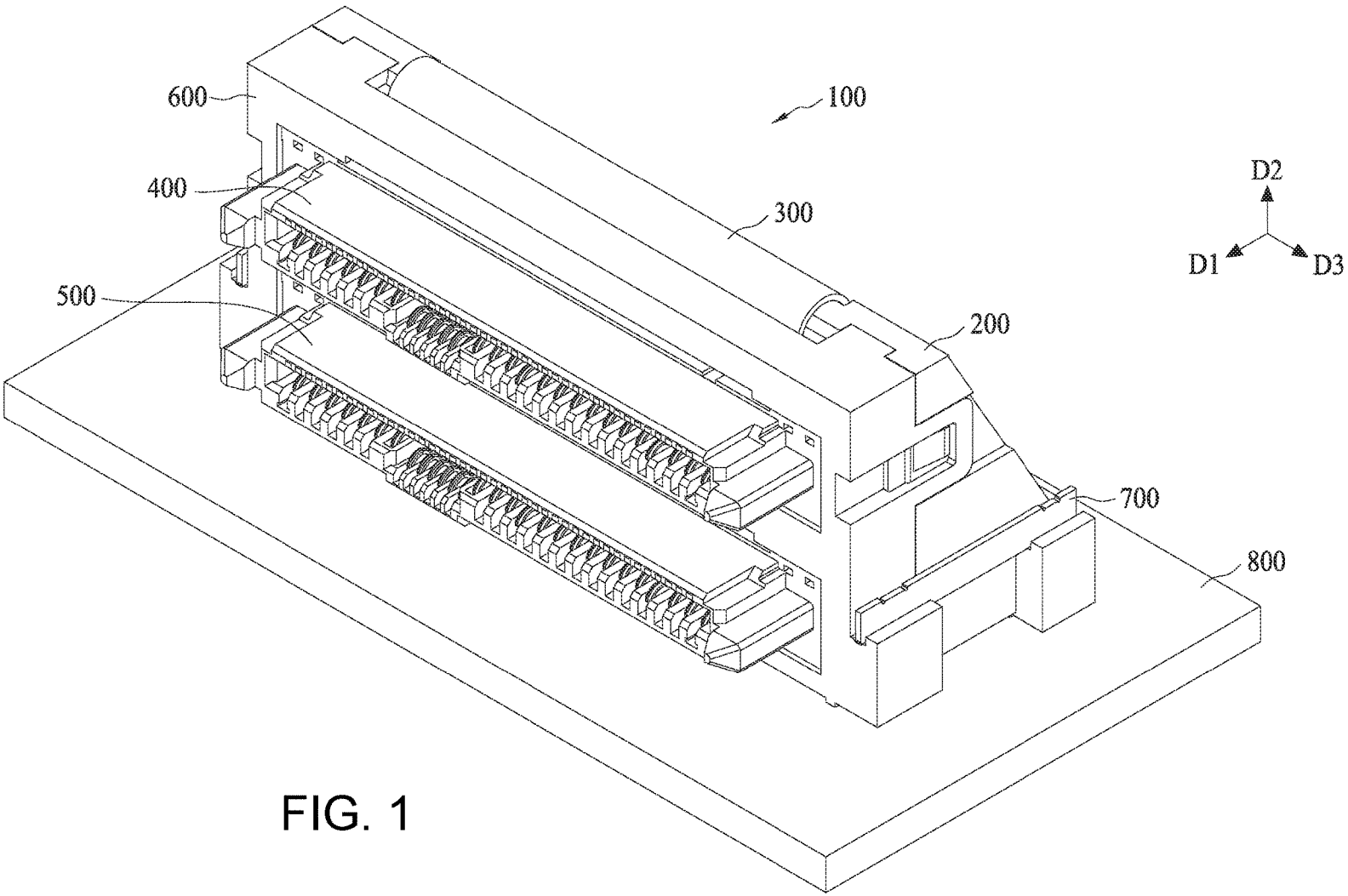
FIG. 1 is an assembled perspective view that an electrical connection device of an embodiment of the present disclosure is mounted on a substrate.

The following disclosed content provides many different embodiments or examples so as to implement the different features of the present disclosure. Specific examples of components and configurations are described below to simplify the disclosed content of the present disclosure. It is certainly that these disclosed features are to be considered as an exemplification, and are not intended to limit the present disclosure. For example, that a first feature is formed on or above a second feature in following description may comprise the embodiment that the first feature and the second feature are formed with direct contact, and also may comprise the other embodiments that other feature is formed between the first feature and the second feature so that the first feature and the second feature are not in direct contact. Also, the present disclosure may use same reference numerals in different examples for the purpose of simplicity and clarity instead of limiting the relationship between the different embodiments and/or the structure discussed.

Also, the present disclosure may use corresponding spatial words, a brief description of similar words such as under, below, lower, above, higher, used for explaining the relationship between a component or feature and another component or feature as shown in figures. The corresponding spatial words can explain different orientations of devices in use or in operation besides the orientations described in figures. Devices may be positioned (rotating by 90 degrees or in other orientation), and the corresponding spatial description of the present disclosure can be explained correspondingly. With the understanding that when a feature is formed above another feature or a substrate, other feature can be located therebetween.

Figure 2:
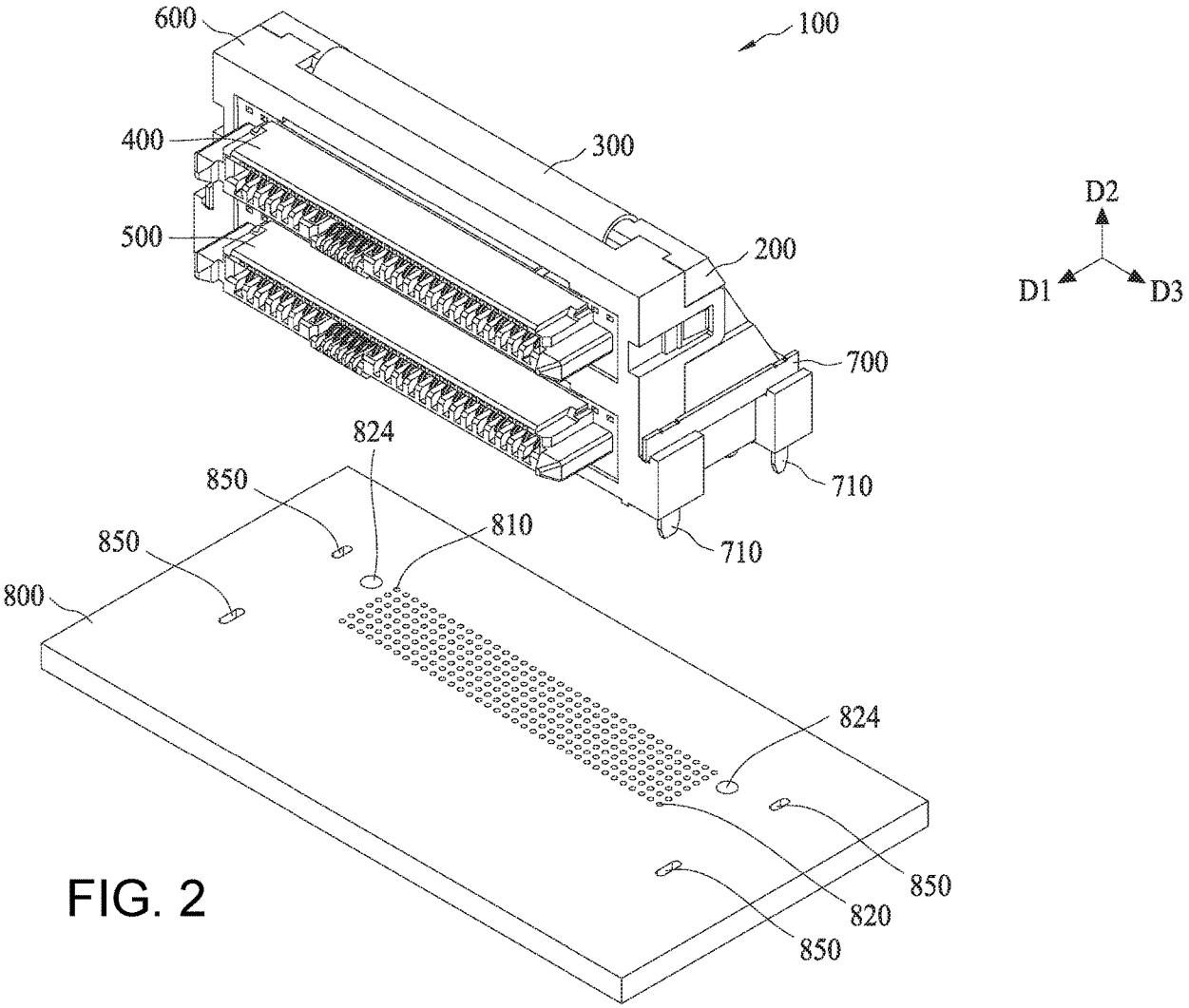
FIG. 2 is an exploded perspective view of FIG. 1 that the electrical connection device is separated from the substrate.
Figure 3:
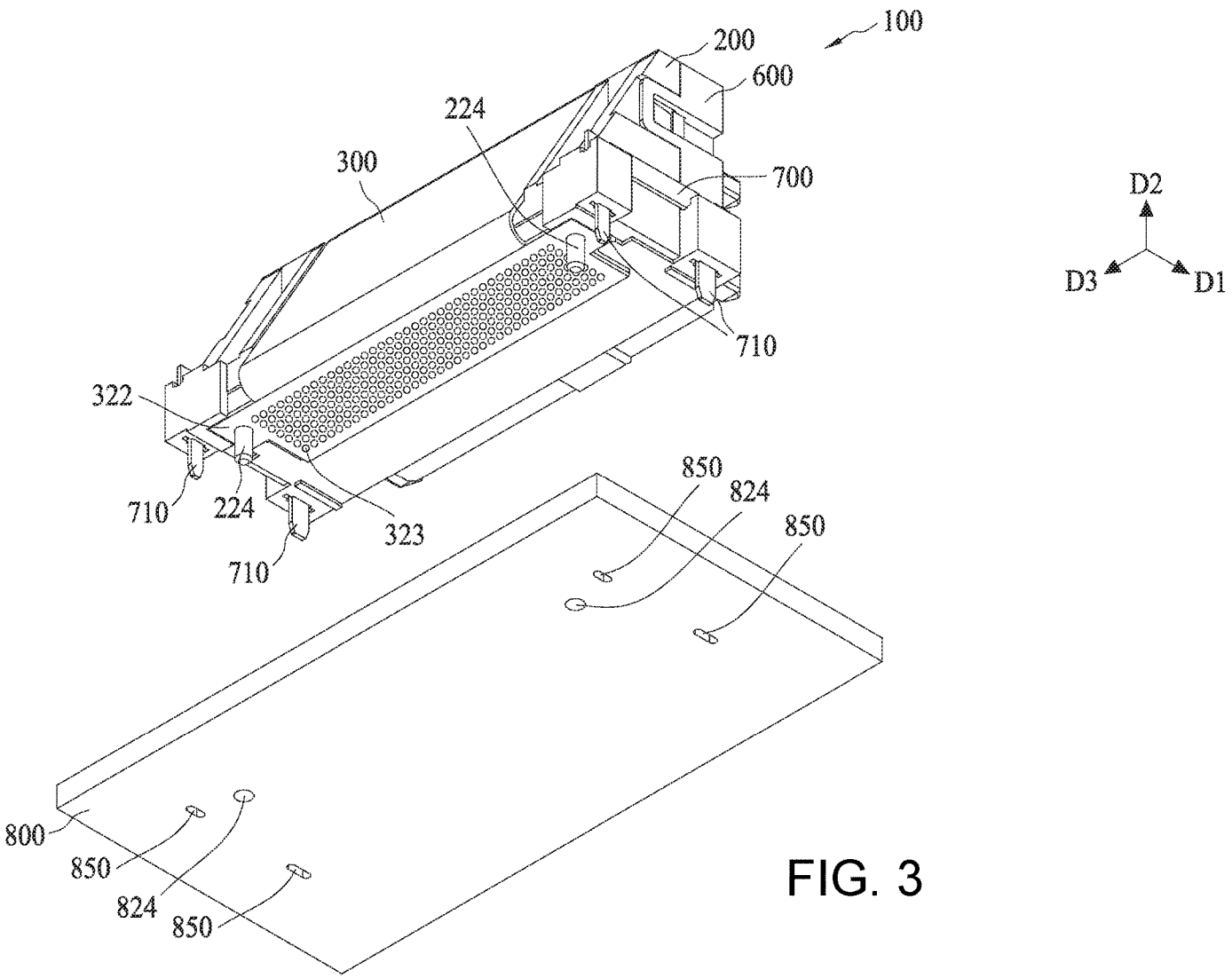
FIG. 3 is an exploded perspective view of FIG. 1 that the electrical connection device is separated from the substrate from another angle.
Figure 4:
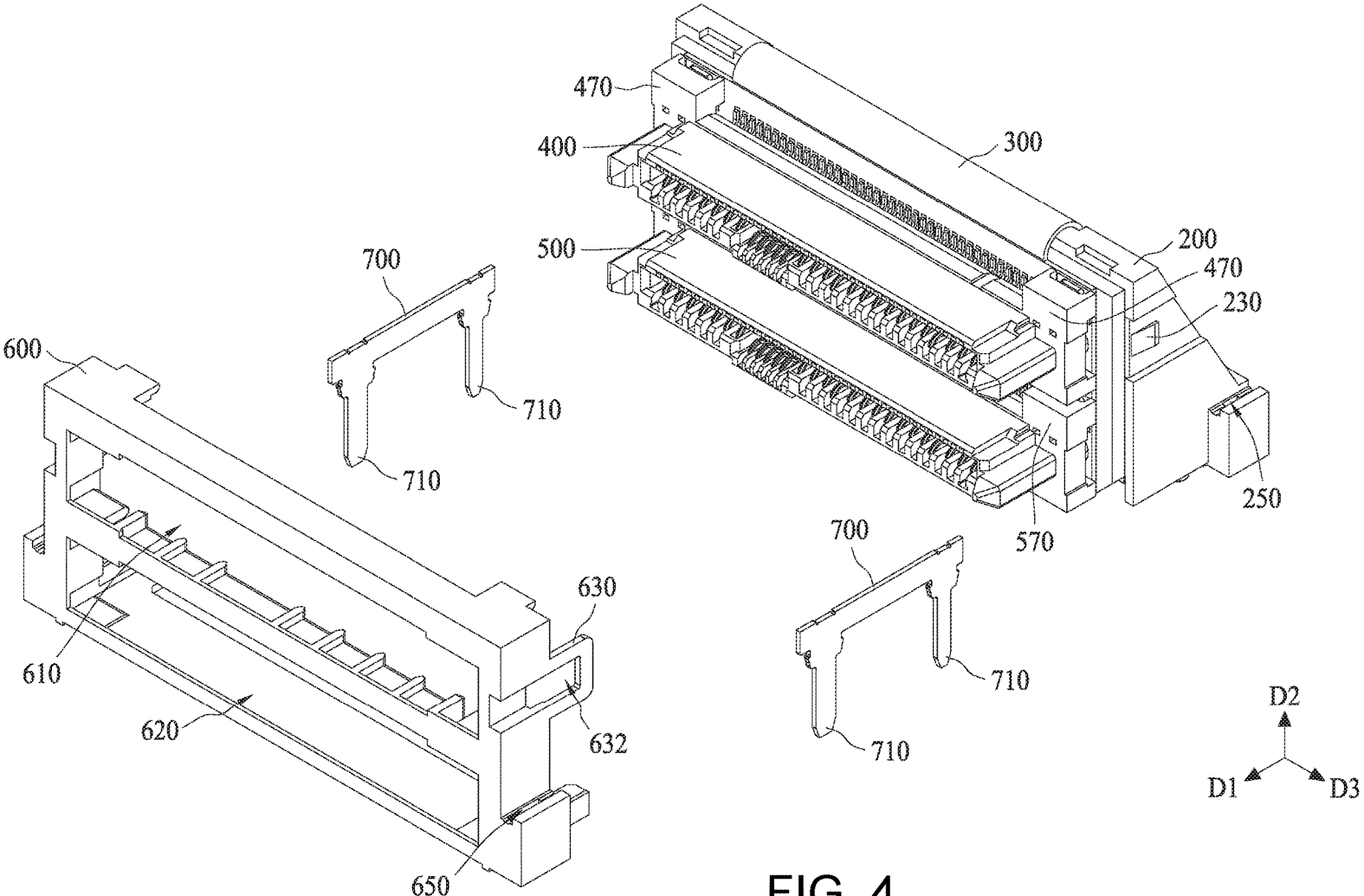
FIG. 4 is an exploded perspective view of the electrical connection device of FIG. 1.
Figure 5:
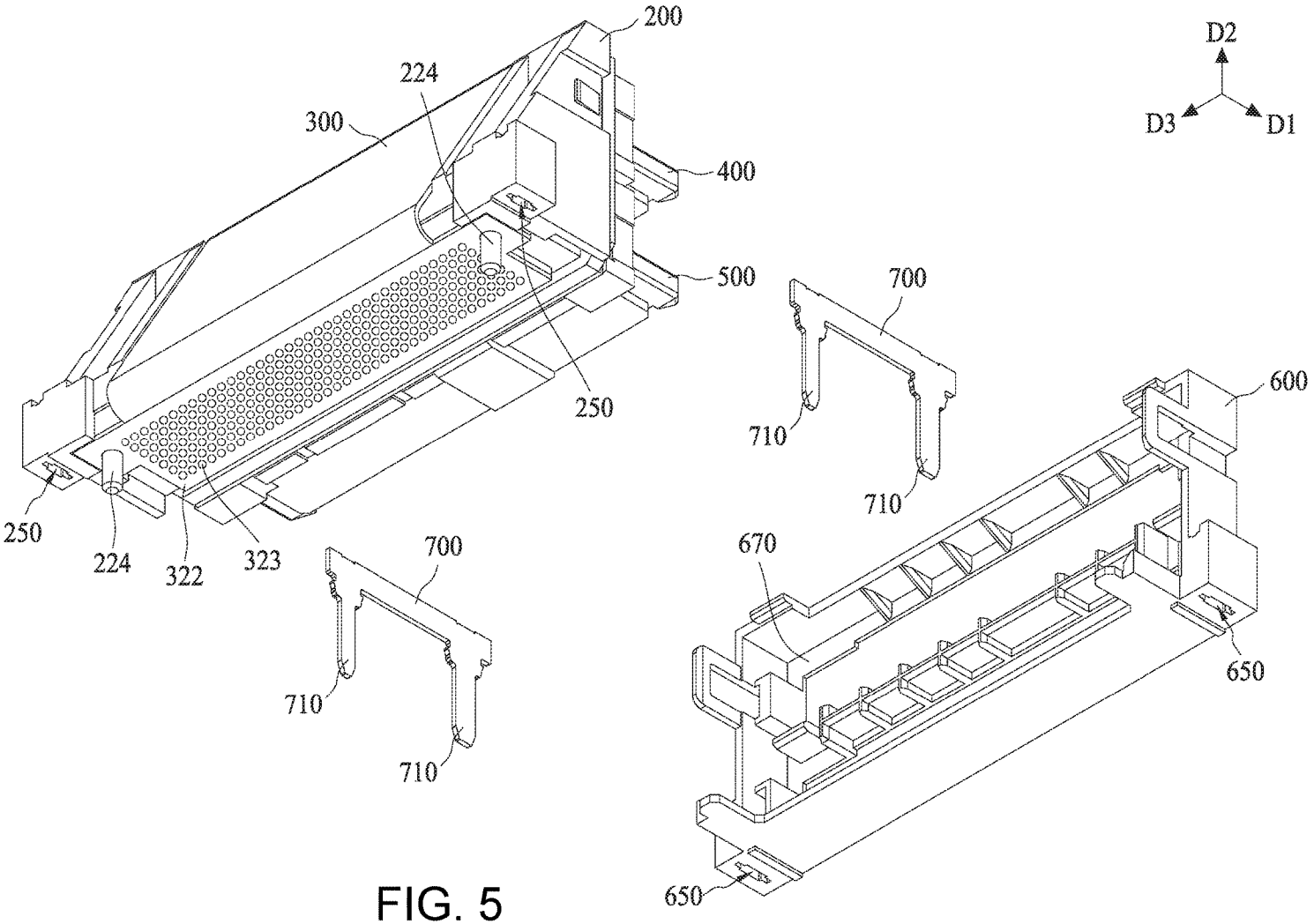
FIG. 5 is an exploded perspective view of the electrical connection device of FIG. 1 from another angle.
Figure 6:
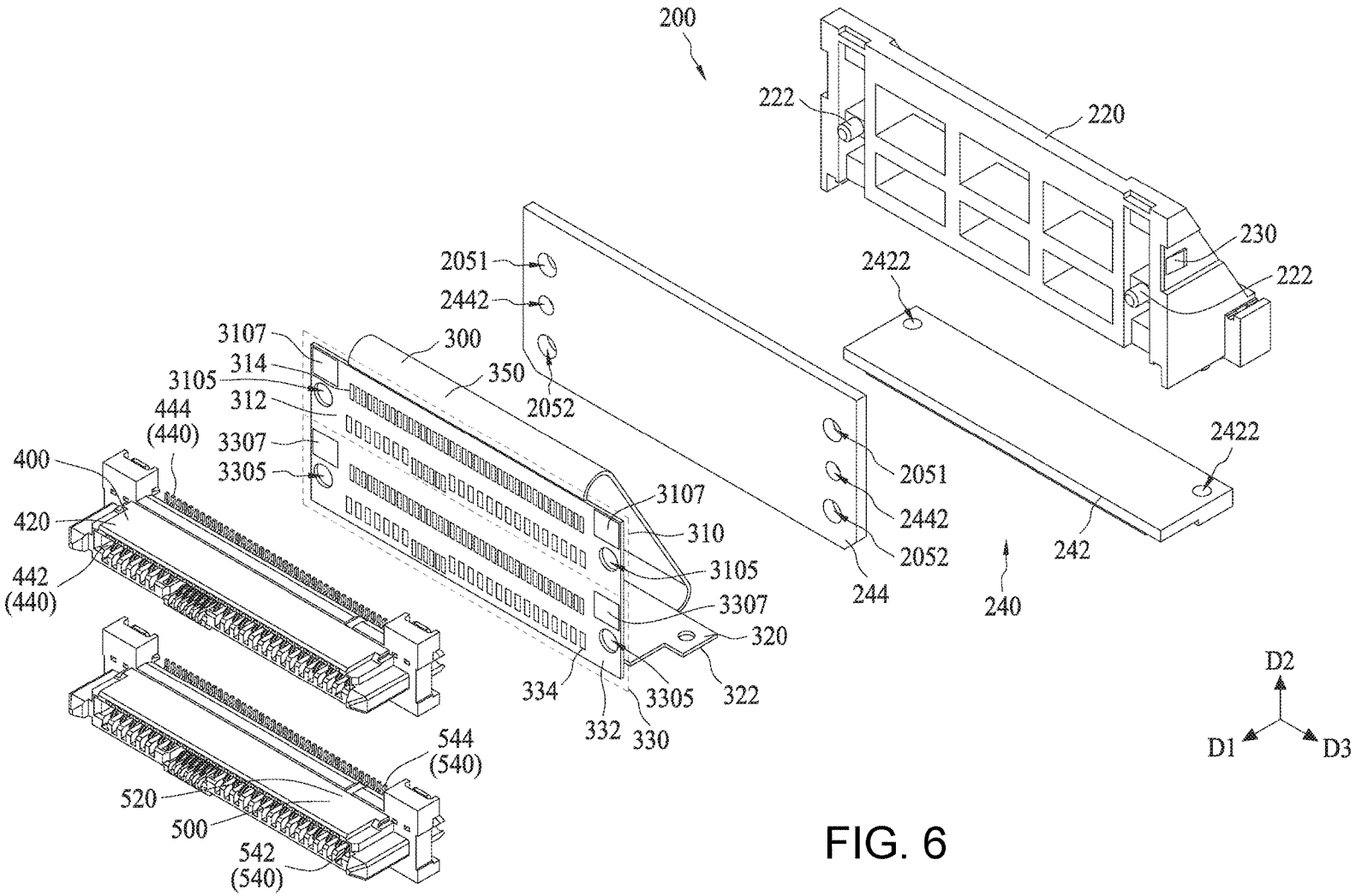
FIG. 6 is a partial exploded perspective view of the electrical connection device of FIG. 1.
Figure 7:
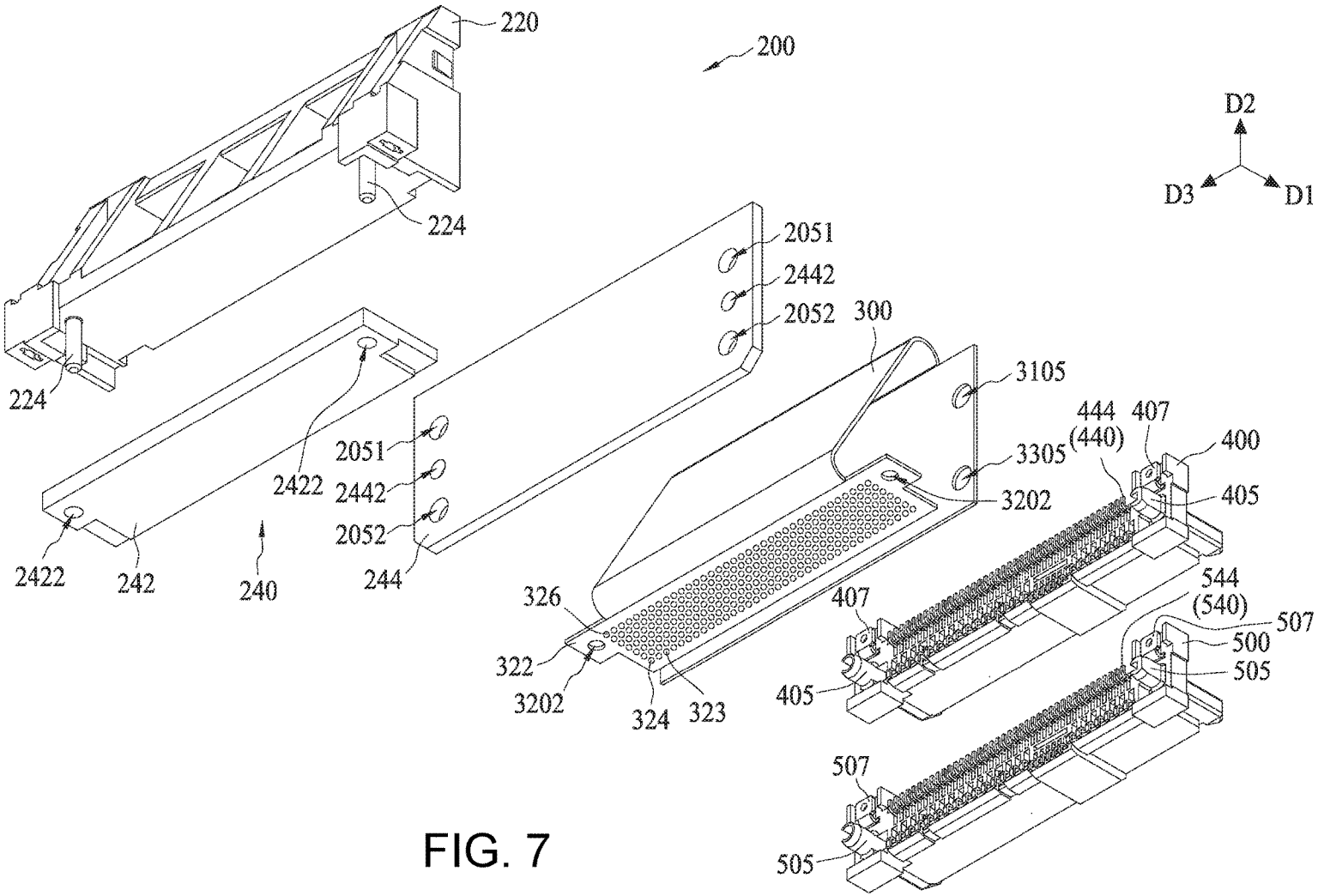
FIG. 7 is a partial exploded perspective view of the electrical connection device of FIG. 1 from another angle.

FIG. 1 is an assembled perspective view that an electrical connection device 100 in an embodiment of the present disclosure is mounted on a substrate 800. FIG. 2 is an exploded perspective view of FIG. 1 that the electrical connection device 100 is separated from the substrate 800. FIG. 3 is an exploded perspective view of FIG. 1 that the electrical connection device 100 is separated from the substrate 800 from another angle. FIG. 4 is an exploded perspective view of the electrical connection device 100 of FIG. 1. FIG. 5 is an exploded perspective view of the electrical connection device 100 of FIG. 1 from another angle. FIG. 6 is a partial exploded perspective view of the electrical connection device 100 of FIG. 1, in which a cover 600 of the electrical connection device 100 is omitted in the figure. FIG. 7 is a partial exploded perspective view of the electrical connection device 100 of FIG. 1 from another angle, in which the cover 600 is omitted in the figure.

Referring to FIG. 1 to FIG. 7, the electrical connection device 100 comprises a base 200, a flexible circuit board 300, a first connector 400, a second connector 500, a cover 600 and two fixing members 700. The two fixing members 700 are configured to fix an assembly of the base 200, the cover 600 and the substrate 800, which will be described in detail below.

The base 200 comprises a base body 220 and a supporting portion 240. The base body 220 is engaged with the supporting portion 240.

The supporting portion 240 comprises a first supporting portion 244 and a second supporting portion 242. The first supporting portion 244 is engaged with the base body 220 along a first direction D1. The second supporting portion 242 is engaged with the base body 220 along a second direction D2 which is different from the first direction D1. In some embodiments, the first direction D1 is perpendicular to the second direction D2. In some embodiments, there is an angle between the first direction D1 and the second direction D2 which is not zero degree.

The base body 220 comprises two first protruding posts 222 arranged along a third direction D3 and extending in the first direction D1 and two second protruding posts 224 arranged along the third direction D3 and extending in the second direction D2. In an embodiment, the third direction D3 is perpendicular to the first direction D1 and the second direction D2. The first supporting portion 244 comprises two first through holes 2442 provided along the third direction D3, the second supporting portion 242 comprises two second through holes 2422 provided along the third direction D3. The engagement of the base body 220 with the first supporting portion 244 is positioned and fixed by that the first protruding posts 222 respectively pass through the first through holes 2442, the engagement of the base body 220 with the second supporting portion 242 is positioned and fixed by that the second protruding posts 224 respectively pass through the second through holes 2422.

Figure 9:
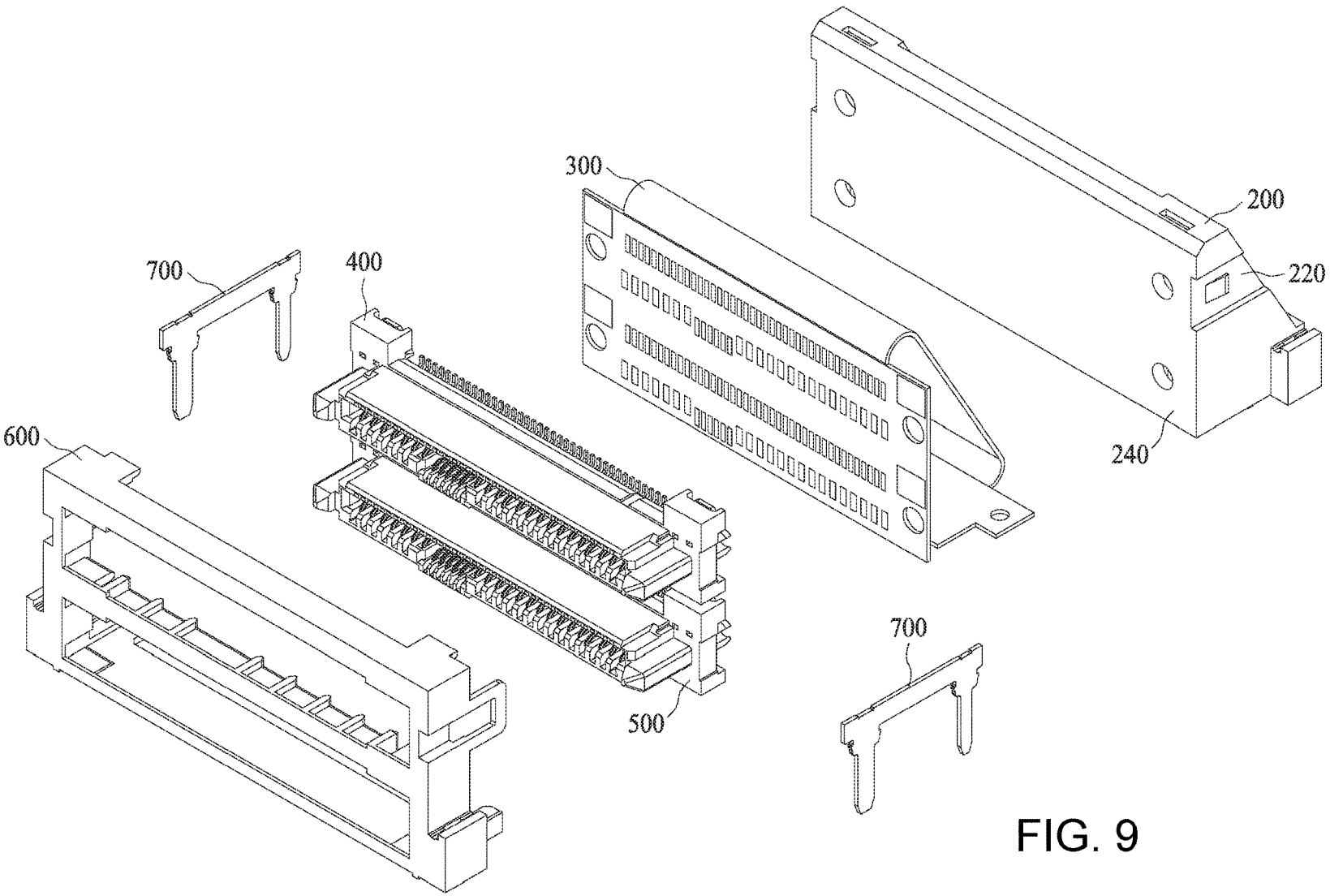
FIG. 9 is a partial exploded perspective view of an electrical connection device of an embodiment of the present disclosure.
Figure 10:
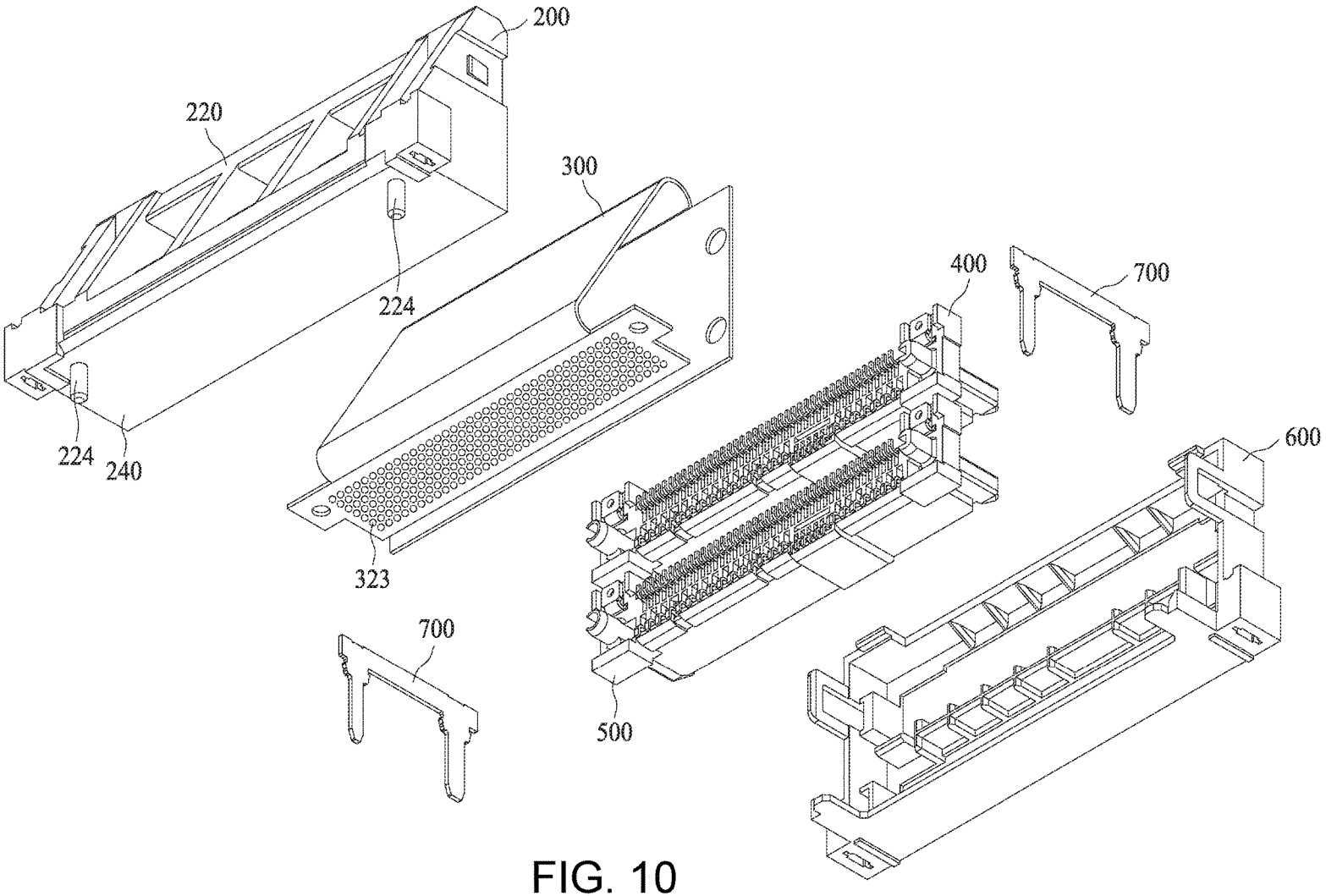
FIG. 10 is a partial exploded perspective view of the electrical connection device of FIG. 9 from another angle.

In the embodiment, the base body 220, the first supporting portion 244, the second supporting portion 242 are independent from each other, and thus may respectively contain different materials, for example the base body 220 contains a plastic material, and the first supporting portion 244 or the second supporting portion 242 contains a metal material. In some embodiments, the first supporting portion 244 and the second supporting portion 242 can be integrated. In other embodiments, the base body 220 of the base 200 and the supporting portion 240 also can be integrally formed (as shown in FIG. 9 and FIG. 10).

The flexible circuit board 300 can be a plate shape or a sheet shape. The flexible circuit board 300 comprises a first mating portion 310, a second mating portion 330, a connecting portion 350 and a mounting portion 320. In an embodiment that the first direction D1 is perpendicular to the second direction D2, the first mating portion 310 and the second mating portion 330 are arranged along the second direction D2.

The first mating portion 310 comprises a first mating surface 312. The first mating surface 312 is configured to be supported by the first supporting portion 244 in the first direction D1. A plurality of first soldering pads 314 are configured on the first mating surface 312

The second mating portion 330 comprises a second mating surface 332. The second mating surface 332 is configured to be supported by the first supporting portion 244 in the first direction D1. A plurality of second soldering pads 334 are configured on the second mating surface 332. In the embodiment, the first mating portion 310 and the second mating portion 330 are arranged along the second direction D2. Accordingly, the first mating surface 312 and the second mating surface 332 are positioned in the same plane and also arranged along the second direction D2.

The mounting portion 320 is configured to be connected to the first mating portion 310 via the connecting portion 350. The mounting portion 320 comprises a mounting surface 322. A plurality of conductive blocks 323 are configured on the mounting surface 322. The plurality of conductive blocks 323 comprise a plurality of first conductive blocks 324 and a plurality of second conductive blocks 326. In some embodiments, the first conductive block 324 comprises a solder ball. The first conductive block 324 is not limited to any shapes, and the first conductive block 324 can be circular, cylindrical, triangular, square or any other shapes. In some embodiments, the second conductive block 326 comprises the solder ball. The second conductive block 326 is not limited to any shapes, and the second conductive block 326 can be circular, cylindrical, triangular, square shape or any other shapes. A configuration of conductive traces will be illustrated in detail in FIG. 13.

In the embodiment, the assembly of the flexible circuit board 300 and the base 200 is that the flexible circuit board 300 surrounds and covers the base 200, in which the first mating portion 310 and the second mating portion 330 of the flexible circuit board 300 are engaged with the first supporting portion 244 of the supporting portion 240 of the base 200 along the first direction D1 and supported by the first supporting portion 244; and the mounting portion 320 of the flexible circuit board 300 is engaged with the second supporting portion 242 of the supporting portion 240 of the base 200 along the second direction D2 and supported by the second supporting portion 242. The mounting portion 320 further comprises two third through holes 3202 positioned in the third direction D3, when the mounting portion 320 is engaged with the second supporting portion 242, the second protruding posts 224 of the base body 220 of the base 200 respectively pass through the third through holes 3202 to help position and fix.

Although the flexible circuit board 300 itself is relatively soft, when the first mating portion 310, the second mating portion 330 and the mounting portion 320 of the flexible circuit board 300 are respectively engaged with the first connector 400, the second connector 500 and the substrate 800, the first mating portion 310, the second mating portion 330 and the mounting portion 320 of the flexible circuit board 300 may maintain flat without deformation under support from the supporting portion 240, avoiding a poor engagement such as an insufficient solder when using a technology such as the surface-mount technology.

The first connector 400 is engaged with the first mating portion 310 of the flexible circuit board 300 along the first direction D1. The first connector 400 comprises a first insulative housing 420 and a plurality of first terminals 440 fixed to the first insulative housing 420. Each first terminal 440 comprises a first contacting portion 442 and a first soldering portion 444. The electrical connection device 100 connects with an external circuit end (not shown) via the first contacting portion 442, the first soldering portion 444 is connected to the first soldering pad 314 of the first mating surface 312 of the first mating portion 310 of the flexible circuit board 300 by a technology such as the surface-mount technology. Additionally, the first connector 400 further comprises two first positioning posts 405 arranged along the third direction D3 and two first fixing pieces 407 arranged along the third direction D3. The first mating surface 312 further comprises two first positioning holes 3105 arranged along the third direction D3 and two first fixing pads 3107 arranged along the third direction D3. The first supporting portion 244 further comprises two third positioning holes 2051 arranged along the third direction D3. When the first connector 400 is engaged with the first mating portion 310, the two first positioning posts 405 respectively pass through the two first positioning holes 3105 of the first mating surface 312 and respectively pass through the two third positioning holes 2051 of the first supporting portion 244 to be positioned, and the two first fixing pieces 407 are respectively connected to the two first fixing pads 3107 by a technology such as the surface-mount technology, so as to achieve the engagement of the first connector 400 with the first mating portion 310 and the first supporting portion 244.

The second connector 500 is engaged with the second mating portion 330 of the flexible circuit board 300 along the first direction D1. The second connector 500 comprises a second insulative housing 520, and a plurality of second terminals 540 fixed to the second insulative housing 520. Each second terminal 540 comprises a second contacting portion 542 and a second soldering portion 544. The electrical connection device 100 connects with an external circuit end (not shown in Figures) via the second contacting portion 542, the second soldering portion 544 is connected to the second soldering pad 334 of the second mating surface 332 of the second mating portion 330 of the flexible circuit board 300 by a technology such as the surface-mount technology. Additionally, the second connector 500 further comprises two second positioning posts 505 arranged along the third direction D3 and two second fixing pieces 507 arranged along the third direction D3. The second mating surface 332 further comprises two second positioning holes 3305 arranged along the third direction D3 and two second fixing pads 3307 arranged along the third direction D3. The first supporting portion 244 further comprises two fourth positioning holes 2052 arranged along the third direction D3. When the second connector 500 is engaged with the second mating portion 330, the two second positioning posts 505 respectively pass through the two second positioning holes 3305 of the second mating surface 332 and respectively pass through the two fourth positioning holes 2052 of the second supporting portion 244 to be positioned, and the two second fixing pieces 507 are respectively connected to the two second fixing pads 3307 by a technology such as the surface-mount technology, so as to achieve the engagement of the second connector 500 with the second mating portion 330 and the first supporting portion 244. In an embodiment, the first connector 400 or the second connector 500 can be a SAS connector or a high frequency connector.

The cover 600 is engaged with the base 200 along the first direction D1. The cover 600 is defined with a first opening 610 and a second opening 620, the cover 600 comprises two latching portions 630 positioned in the third direction D3, each of the two latching portions 630 is defined with a latching opening 632. The base 200 further comprises two protruding blocks 230 positioned in the third direction D3. The cover 600 is engaged with the base 200 by that the latching openings 632 are respectively latched with the protruding blocks 230. The first opening 610 and the second opening 620 respectively expose the first contacting portions 442 of the first connector 400 and the second contacting portions 542 of the second connector 500. In other embodiments, the cover 600 comprises one opening, and contacting portions of a plurality of connectors can be exposed by using only one opening, for example, the one opening can expose both the first contacting portions 442 and the second contacting portions 542.

The cover 600 can strengthen a mechanical strength of the electrical connection device 100, and protect the first soldering portions 444 of the first connector 400, the second soldering portions 544 of the second connector 500, and the first soldering pads 314 and the second soldering pads 334 of the flexible circuit board 300. The cover 600 can also prevent the first connector 400 and the second connector 500 from detaching from the flexible circuit board 300, the mechanism is as follows: the cover 600 comprises a pressing surface 670 (as shown in FIG. 5), the first connector 400 comprises two shoulder portions 470 (as shown in FIG. 4) arranged along the third direction D3, the second connector 500 comprises two shoulder portions 570 arranged along the third direction D3, when the cover 600 is engaged with the base 200, the pressing surface 670 presses the shoulder portions 470 and the shoulder portions 570, so as to prevent the first connector 400 and the second connector 500 from detaching the flexible circuit board 300.

The substrate 800 is engaged with an assembly of the base 200, the flexible circuit board 300, the first connector 400, the second connector 500 and the cover 600 along the third direction D3. The substrate 800 has a plurality of third soldering pads 810 and a plurality of fourth soldering pads 820 which are respectively connected with the plurality of first conductive blocks 324 and the plurality of second conductive blocks 326 of the mounting portion 320 of the flexible circuit board 300 by a technology such as the surface-mount technology. Because the first conductive block 324 is connected to the first contacting portion 442 of the first connector 400 through a first conductive trace 380 (referring to FIG. 13) and the first soldering pad 314 of the flexible circuit board 300 and the first soldering portion 444 of the first connector 400, the third soldering pad 810 of the substrate 800 is also connected to the first contacting portion 442 of the first connector 400 and connected to the external circuit through the first contacting portion 442. Similarly, because the second conductive block 326 is connected to the second contacting portion 542 of the second connector 500 through a second conductive trace 390 (referring to FIG. 13) the second soldering pad 334 of the flexible circuit board 300 and the second soldering portion 544 of the second connector 500, the fourth soldering pad 820 of the substrate 800 is also connected to the second contacting portion 542 of the second connector 500 and connected to the external circuit through the second contacting portion 542.

The substrate 800 further comprises two fourth through holes 824 which are positioned in the third direction D3 and are respectively passed through by the two second protruding posts 224 of the base 200 to strengthen positioning and fixing. Additionally, the third through hole 3202 of the mounting portion 320 of the flexible circuit board 300 can be bigger than the second protruding post 224, so that the mounting portion 320 has a space to move when the second protruding post 224 passes through the third through hole 3202. This design allows for a space for an automatic calibration (self alignment) when the plurality of first conductive blocks 324 and the plurality of second conductive blocks 326 of the mounting portion 320 are respectively soldered to the plurality of third soldering pads 810 and the plurality of fourth soldering pads 820 of the substrate 800 through a technology such as the surface-mount technology, so that the mounting portion 320 is assembled with the substrate 800 more accurately. In some embodiments, the substrate 800 can be a rigid circuit board.

The two fixing members 700 are positioned in the third direction D3 to fix an assembly of the base 200, the cover 600 and the substrate 800. Each fixing member 700 comprises two end portions 710. The base 200 further comprises two first inserting holes 250 positioned in the third direction D3. The cover 600 further comprises two second inserting holes 650 positioned in the third direction D3. Both ends of the substrate 800 in the third direction D3 each further comprise two third inserting holes 850. The two end portions 710 of each fixing member 700 respectively pass through the first inserting hole 250 and the second inserting hole 650, and then are respectively inserted into and fixed to the two third inserting holes 850, so as to reinforce strength of the engagement of the cover 600 with the base 200, and mount and fix the cover 600 and the base 200 together to the substrate 800. In other embodiments, after the two end portions 710 of each fixing member 700 are respectively inserted into the third inserting holes 850, a technology such as a soldering technology can be used to strengthen the fixing.

Figure 8C:
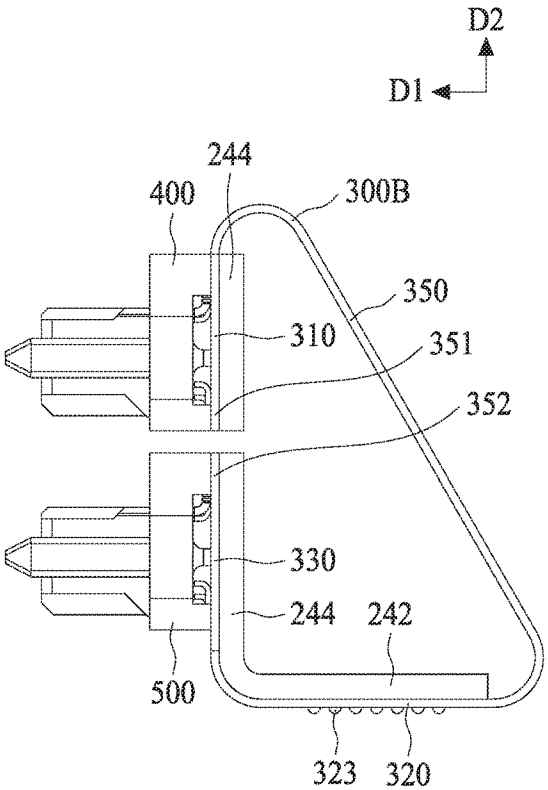
FIG. 8C is a side view that connectors are assembled with a flexible circuit board in an electrical connection device of an embodiment of the present disclosure.
Figure 8B:
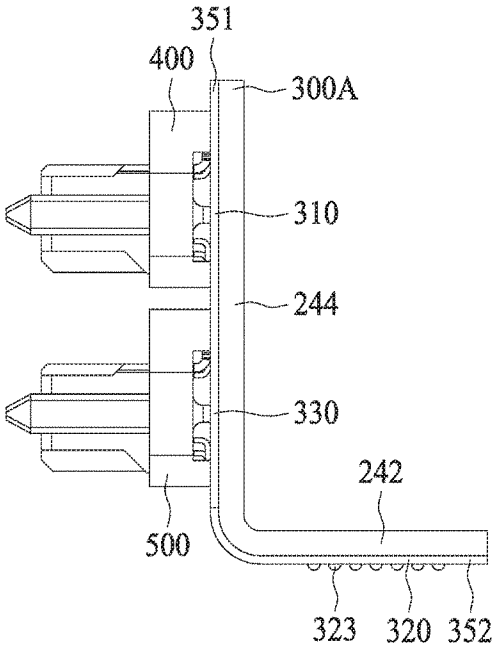
FIG. 8B is a side view that connectors are assembled with a flexible circuit board in an electrical connection device of an embodiment of the present disclosure.
Figure 8A:
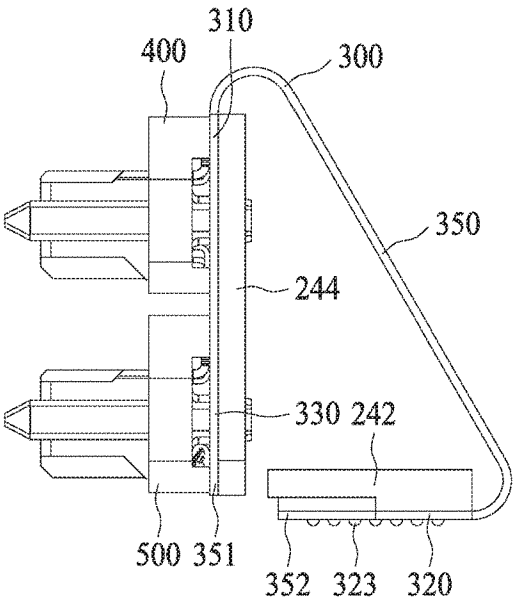
FIG. 8A is a side view that the connectors are assembled with the flexible circuit board in the electrical connection device of the embodiment of the present disclosure.

FIG. 8A, FIG. 8B and FIG. 8C are side views that connectors of electrical connection devices are assembled with flexible circuit boards in different embodiments of the present disclosure. Referring to FIG. 8A, FIG. 8A shows the flexible circuit board 300 of the embodiment in FIG. 1 to FIG. 7. Specifically, the first mating portion 310 and the second mating portion 330 are positioned at a first end 351 of the flexible circuit board 300, the mounting portion 320 is positioned at a second end 352 of the flexible circuit board 300 opposite to the first end 351, the connecting portion 350 connects the first mating portion 310 and the mounting portion 320 to surround and cover the base 200 (Referring to FIG. 1 to FIG. 7). Referring to FIG. 8B, FIG. 8B shows that in a flexible circuit board 300A of another embodiment, the first mating portion 310 and the second mating portion 330 are positioned at the first end 351 of the flexible circuit board 300, the mounting portion 320 is positioned at the second end 352 of the flexible circuit board 300 opposite to the first end 351. In the embodiment, the flexible circuit board 300 does not have the connecting portion 350 which surrounds and covers the base 200 shown in FIG. 8A, the mounting portion 320 is firstly connected to the second mating portion 330 and then connected to the first mating portion 310, and the flexible circuit board 300A is a L-shape viewed from side. Referring to FIG. 8C, FIG. 8C shows a flexible circuit board 300B of another embodiment, the first mating portion 310 is positioned at the first end 351 of the flexible circuit board 300B, the second mating portion 330 is positioned at the second end 352 of the flexible circuit board 300B, the mounting portion 320 is configured between the first mating portion 310 and the second mating portion 330, and has the connecting portion 350 to surround and cover the base 200 and connect the first mating portion 310 and the mounting portion 320.

Compared with the flexible circuit board 300A or the flexible circuit board 300B, the flexible circuit board 300 does not have an L-shaped structure that directly connects the second mating portion 330 and the mounting portion 320, so the flexible circuit board 300 can allow the height in the second direction D2 to be low, and has an advantage of a small overall structure.

In addition, in the design of the flexible circuit board 300B, a wiring of the first mating portion 310 to the mounting portion 320 and a wiring of the second mating portion 330 to the mounting portion 320 do not overlap because they are in different connection directions, and thus the wirings can be designed in the same layer on the flexible circuit board 300B, that is, the first conductive trace 380 connecting signals of the first connector 400 to the mounting portion 320 and the second conductive trace 390 connecting signals of the second connector 500 to the mounting portion 320 can be configured in the same layer on the flexible circuit board 300B. By contrast, in the flexible circuit board 300 or the flexible circuit board 300A, because the wiring of the first mating portion 310 to the mounting portion 320 overlaps with the wiring of the second mating portion 330 to the mounting portion 320, thus a circuit board with one more layer than the flexible circuit board 300B is needed.

Figure 11:
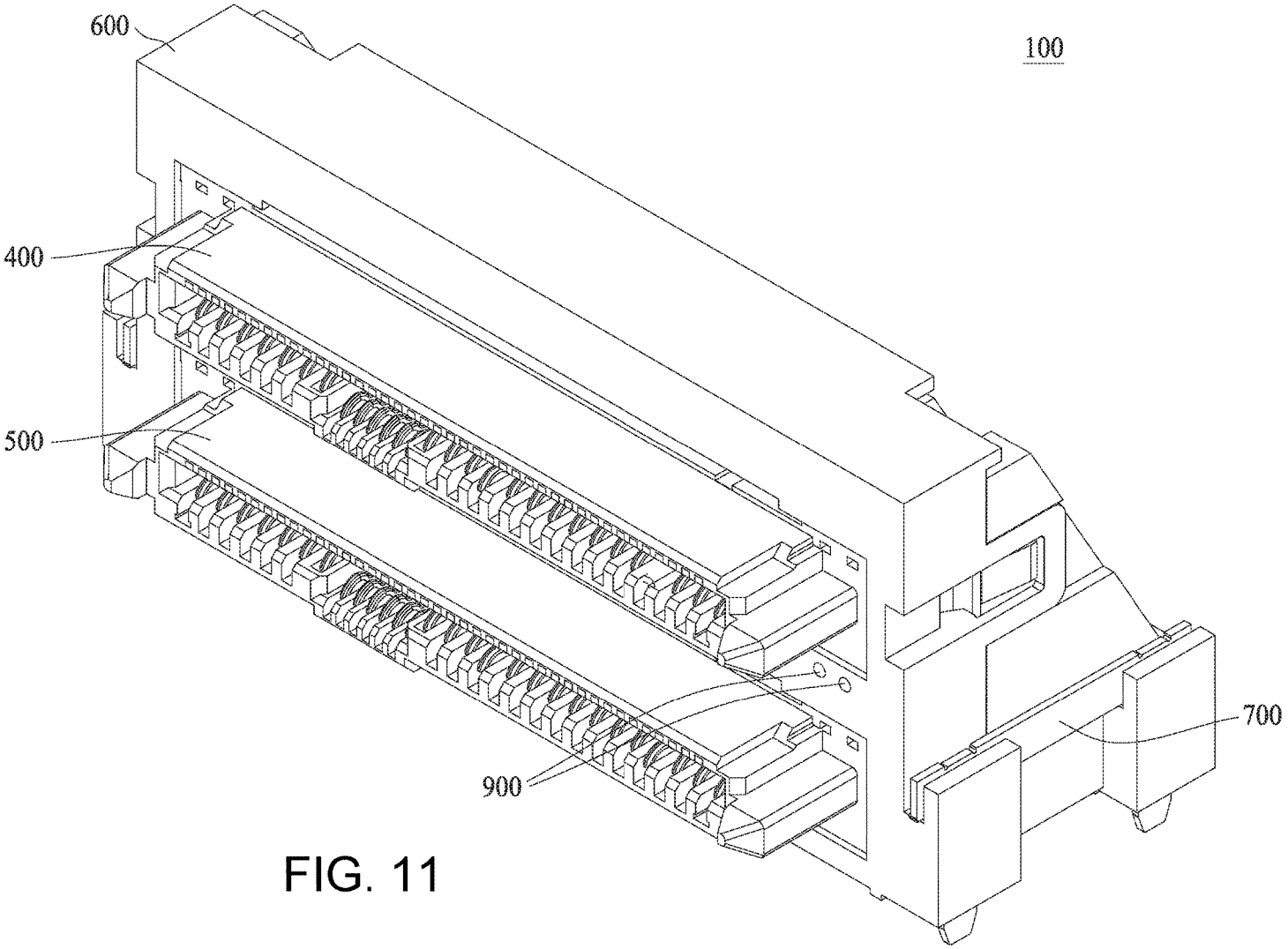
FIG. 11 is a perspective view of an electrical connection device of an embodiment of the present disclosure.
Figure 12:
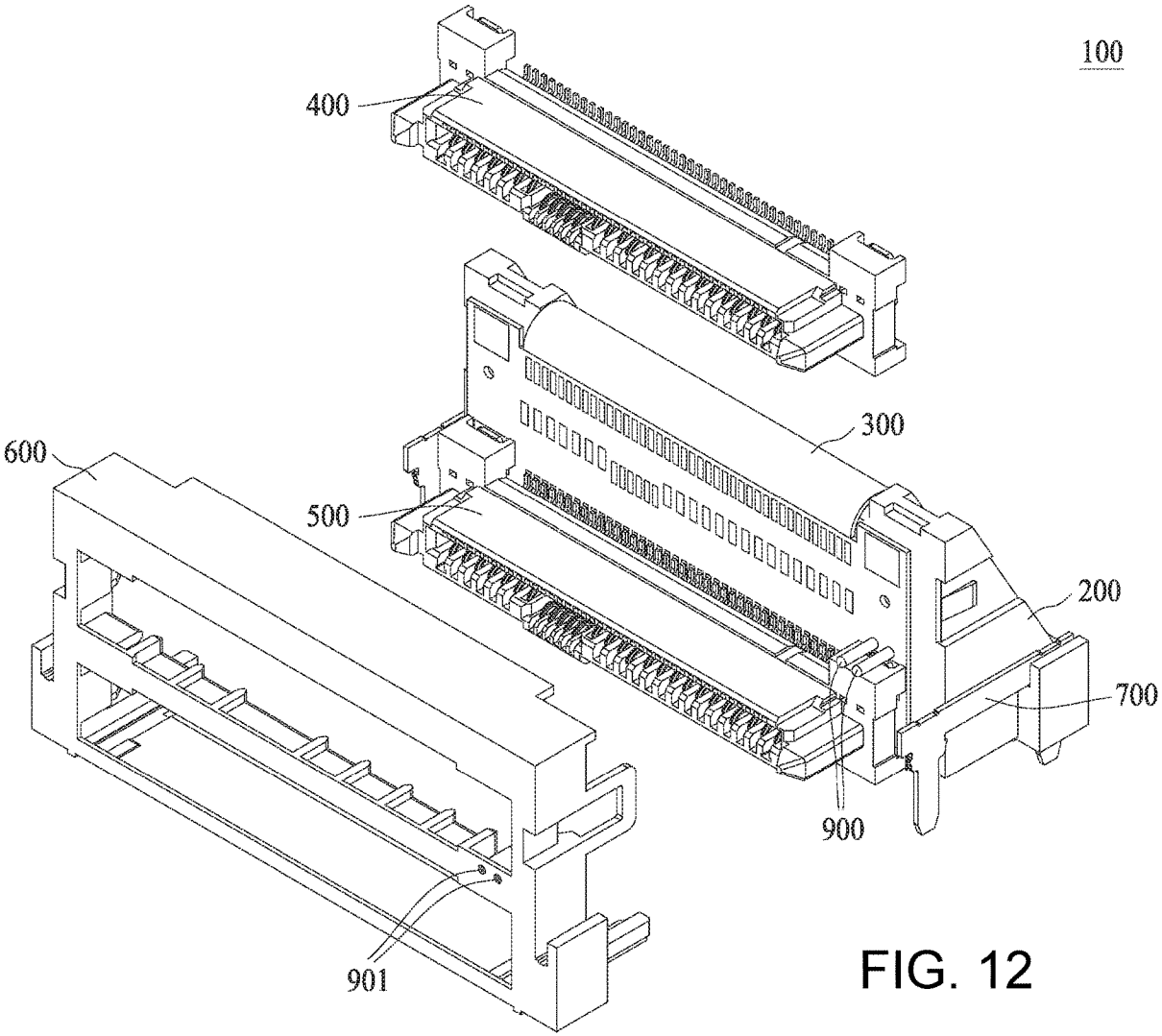
FIG. 12 is an exploded perspective view of the electrical connection device of FIG. 11.

FIG. 11 is a perspective view of an electrical connection device 100 of an embodiment of the present disclosure. FIG. 12 is an exploded perspective view of the electrical connection device 100 of FIG. 11. Referring to FIG. 11 and FIG. 12, in the electrical connection device 100 of the embodiment, the flexible circuit board 300 further comprises two light pipes 900 to guide and concentrate lights representing states of signal transmission emitted from LED element(s) (not shown in figures) mounted on the flexible circuit board 300, the cover 600 further comprises two light holes 901, when the cover 600 is assembled with the flexible circuit board 300 and the base 200 etc. al, the two light pipes 900 respectively pass through the two light holes 901 to expose, the states of signal transmission of the two light pipes 900 can be further observed to detect whether the electrical connector is working. In the embodiment, the number of the light pipes 900 is not limited to two. In some embodiments, the number of light pipes 900 can be one, the number of light holes 901 is the same as the number of light pipes 900.

Figure 13:
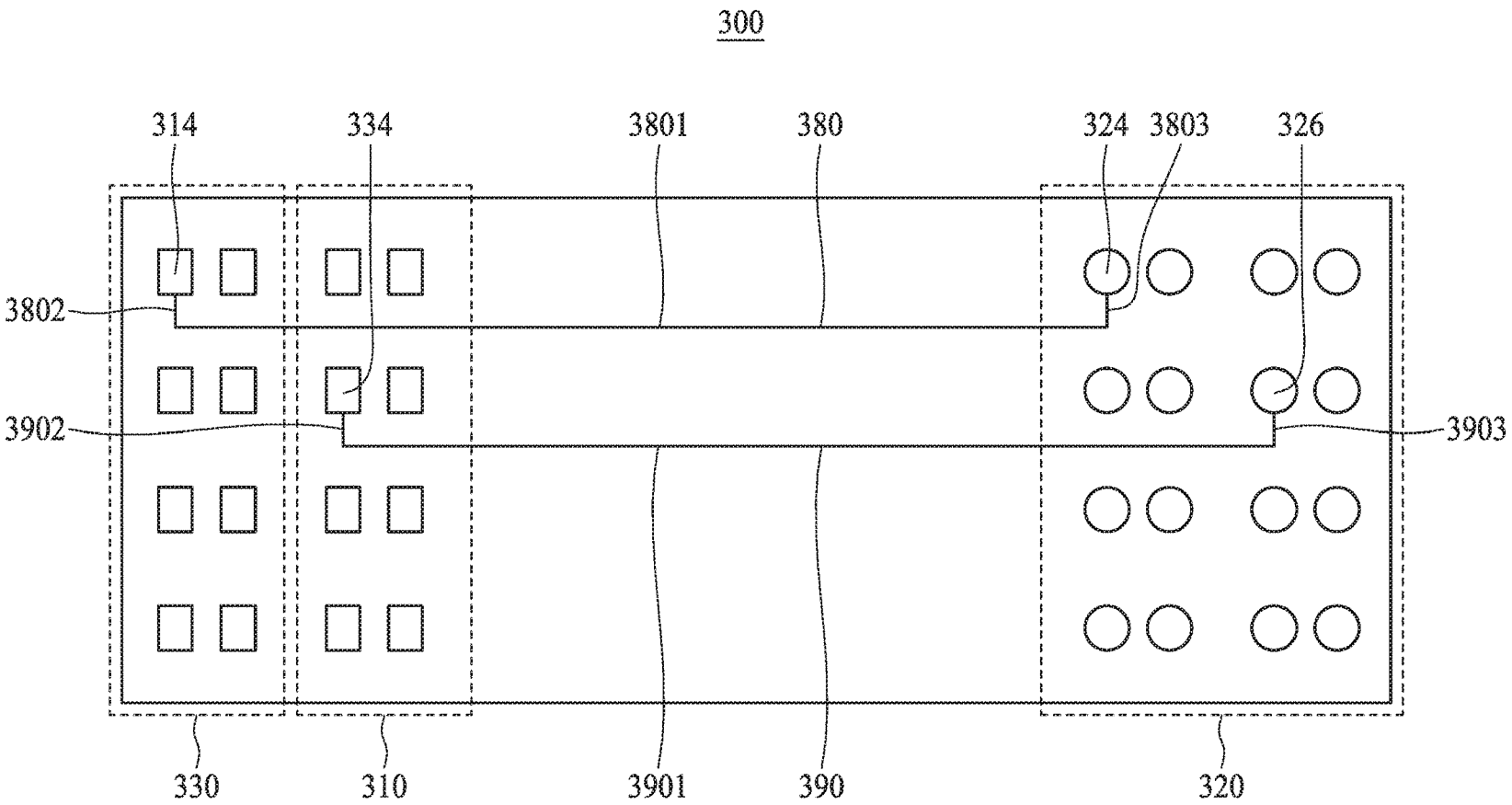
FIG. 13 is a top view of a flexible circuit board in an unfolded state of an embodiment of the present disclosure.

FIG. 13 is a top view of a flexible circuit board 300 in an unfolded state of an embodiment of the present disclosure. Referring to FIG. 13, the plurality of first soldering pads 314 are connected with the plurality of first conductive blocks 324 through the plurality of first conductive traces 380, the plurality of second soldering pads 334 are connected with the plurality of second conductive blocks 326 through the plurality of second conductive traces 390. More specifically, each first conductive trace 380 has a first line body 3801, a first surface soldering end 3802 and a first adapter soldering end 3803. The first line body 3801 is configured in the flexible circuit board 300, the first surface soldering end 3802 connects with the first soldering pad 314, the first adapter soldering end 3803 connects with the first conductive block 324, so as to achieve a connection of each first soldering pad 314 with each first conductive block 324. Similarly, each second conductive trace 390 has a second line body 3901, a second surface soldering end 3902 and a second adapter soldering end 3903. The second line body 3901 is configured in the flexible circuit board 300, the second surface soldering end 3902 connects with the second soldering pad 334, and the second adapter soldering end 3903 connects with the second conductive block 326, so as to achieve a connection of each second soldering pad 334 with each second conductive block 326. Note that in illustration of the embodiment, the number and position of the first soldering pads 314, the second soldering pads 334, the first conductive blocks 324 and the second conductive blocks 326 are only examples, and a relative connection relationship can be configured as actual demand, the present disclosure is not limited thereto, for example, in other embodiments, the first soldering pad 314 may be also connected to the conductive block indicated as 324 in the embodiment.

Figure 14:
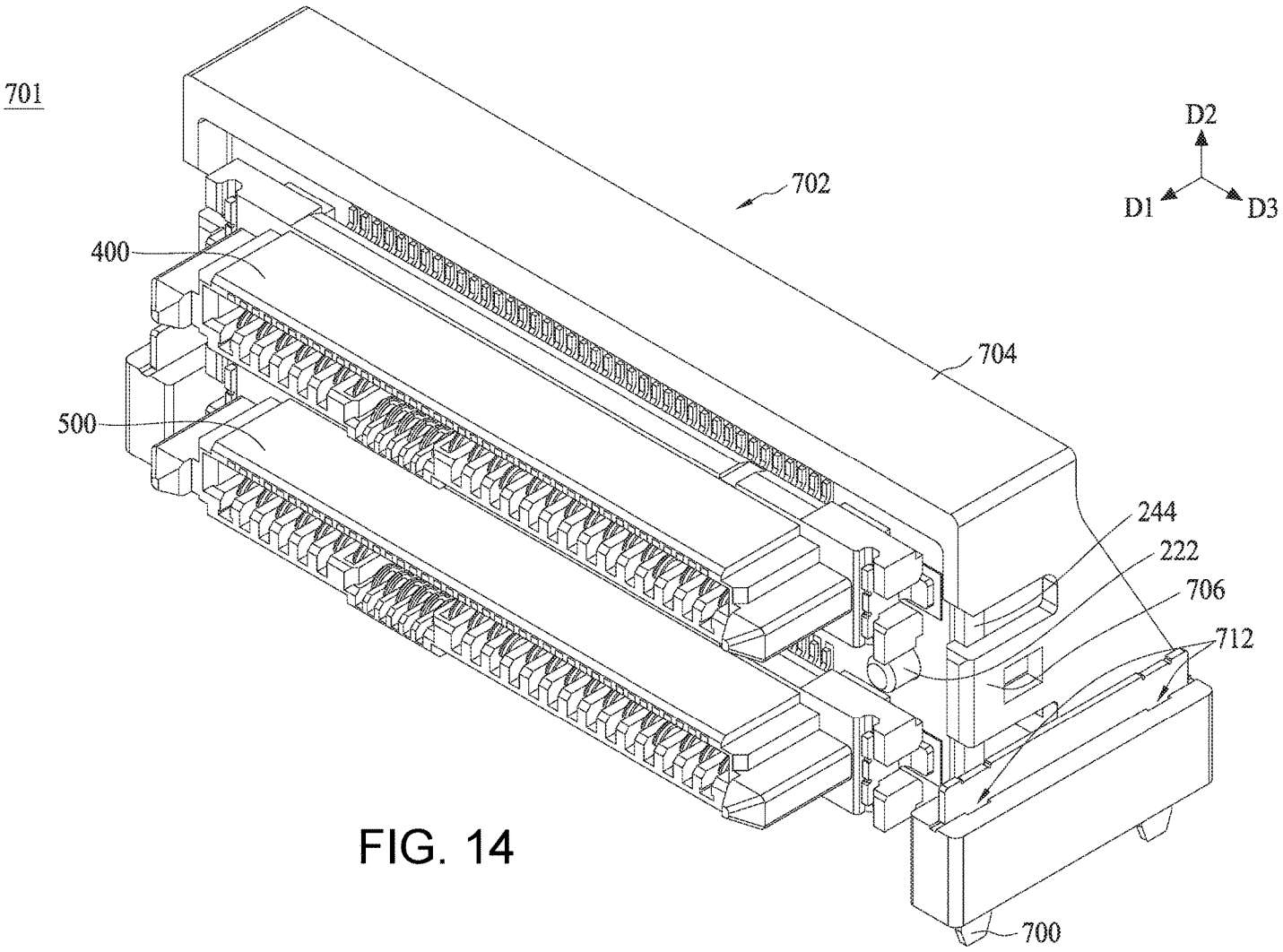
FIG. 14 is an assembled perspective view of another electrical connection device of an embodiment of the present disclosure.
Figure 15:
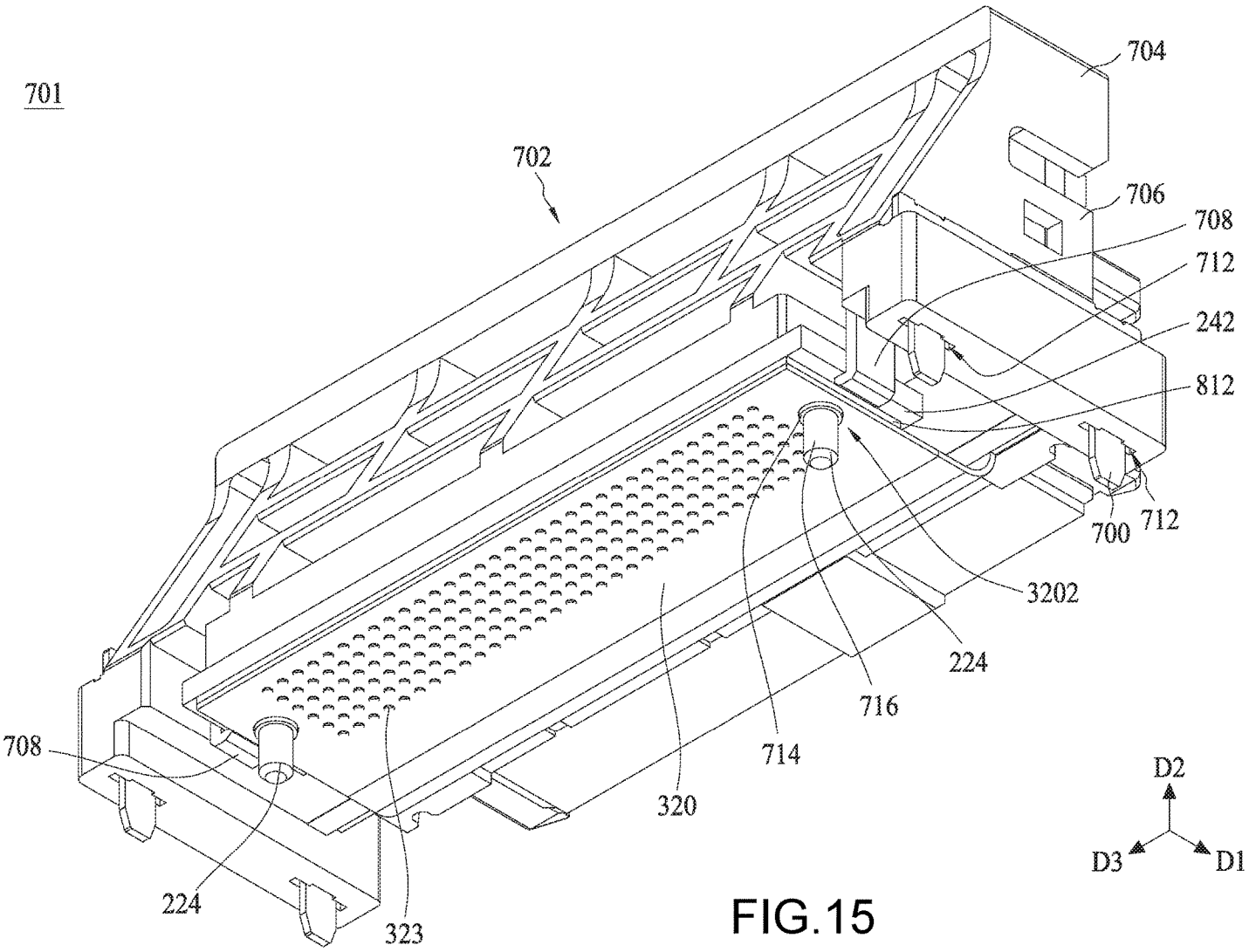
FIG. 15 is an assembled perspective view of the electrical connection device of FIG. 14 from another angle.
Figure 16:
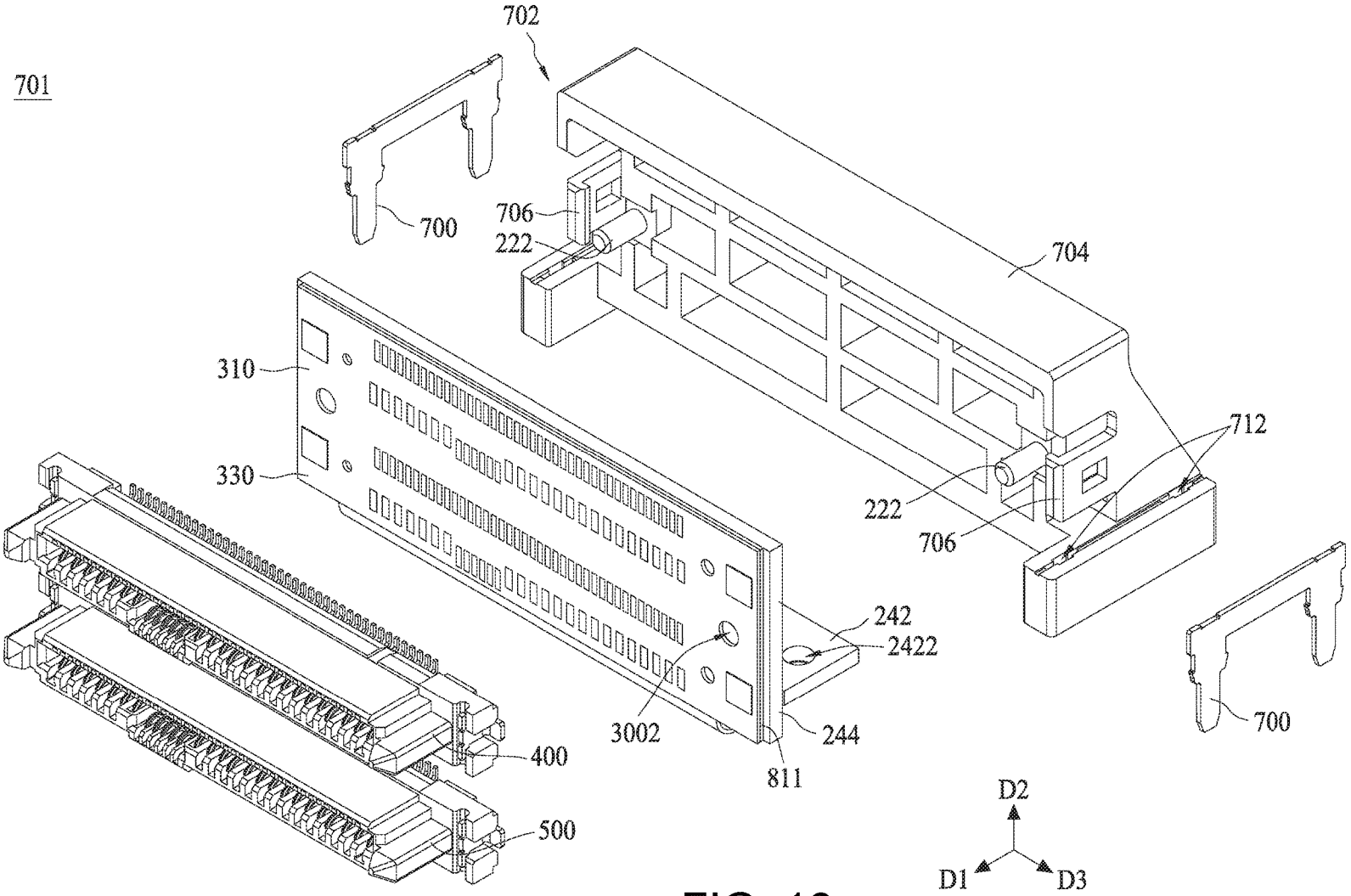
FIG. 16 is an exploded perspective view of the electrical connection device of FIG. 14.
Figure 17:
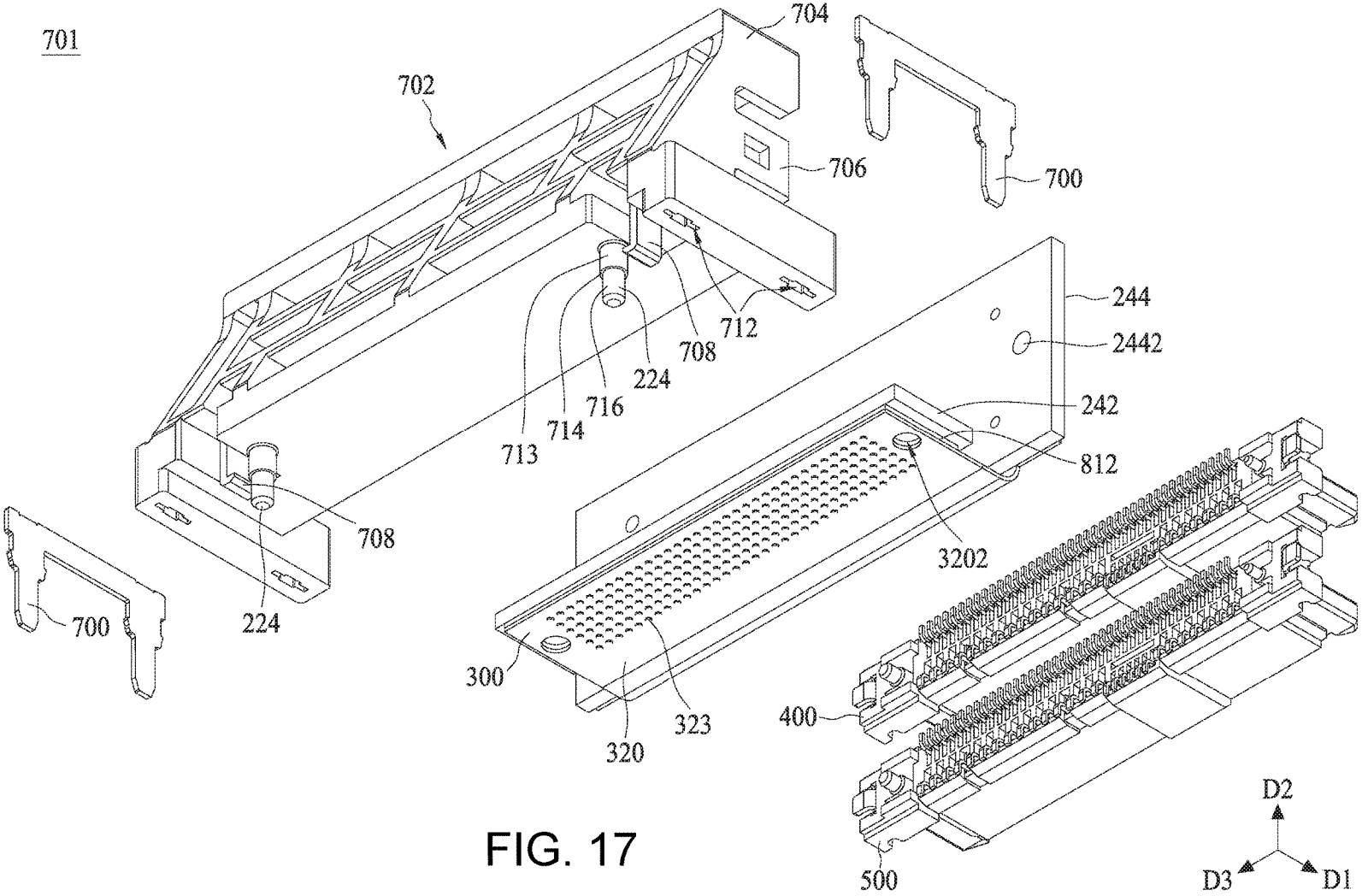
FIG. 17 is an exploded perspective view of the electrical connection device of FIG. 14 from another angle.
Figure 18:
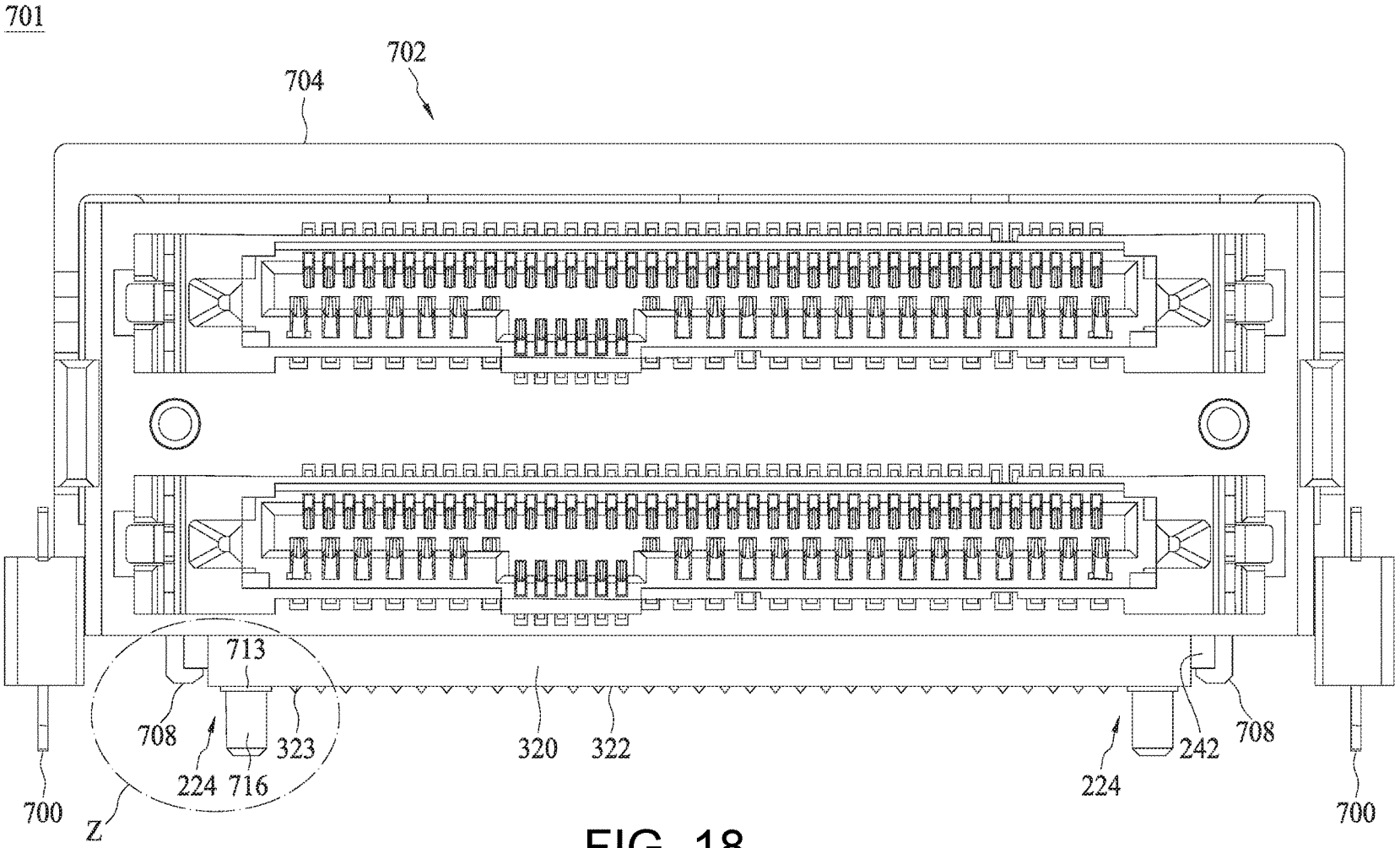
FIG. 18 is a front view of the electrical connection device of FIG. 14.

FIG. 14 is an assembled perspective view of another electrical connection device 701 of an embodiment of the present disclosure. FIG. 15 is an assembled perspective view of the electrical connection device 701 of FIG. 14 from another angle. FIG. 16 is an exploded perspective view of the electrical connection device 701 of FIG. 14. FIG. 17 is an exploded perspective view of the electrical connection device 701 of FIG. 14 from another angle. FIG. 18 is a front view of the electrical connection device 701 of FIG. 14. The electrical connection device 701 is similar to the electrical connection device 100 shown in FIG. 1, The difference is in that the electrical connection device 701 comprises a base 702 including a base body 704. Additionally, in the embodiment, both the first supporting portion 244 and the second supporting portion 242 are independent from the base body 704. In an embodiment, the first supporting portion 244 and the second supporting portion 242 are integrally formed. In other embodiments, the first supporting portion 244 is independent from the second supporting portion 242. A structural relationship of the first supporting portion 244 and the second supporting portion 242 can be as shown in any one of the embodiments in FIG. 8A to FIG. 8C.

The electrical connection device 701 further comprises a first adhesion layer 811 and a second adhesion layer 812. The first adhesion layer 811 is positioned between the first mating portion 310 and the second mating portion 330 of the flexible circuit board 300 and the first supporting portion 244, and is configured to adhere the first mating portion 310 and the second mating portion 330 of the flexible circuit board 300 to the first supporting portion 244. In an embodiment, the first adhesion layer 811 comprises an adhesive layer. The second adhesion layer 812 is positioned between the mounting portion 320 of the flexible circuit board 300 and the second supporting portion 242, and is configured to adhere the mounting portion 320 of the flexible circuit board 300 to the second supporting portion 242. In an embodiment, the second adhesion layer 812 comprises an adhesive layer.

The base body 704 and the first supporting portion 244 are arranged in the first direction D1, and the base body 704 and the second supporting portion 242 are arranged in the second direction D2. The base body 704 comprises a first hook 706 and a second hook 708.

The first hook 706 is configured to latch the first supporting portion 244 of the base 702. However, the present disclosure is not limited thereto. In some embodiments, the first hook 706 is latched to the flexible circuit board 300. Accordingly, the first hook 706 limits the first supporting portion 244 and the flexible circuit board 300 in the first direction D1. Additionally, by a way that the two first through holes 2442 of the first supporting portion 244 and the two fifth through holes 3002 of the flexible circuit board 300 respectively position the two first protruding posts 222 of the base body 704 therein, and the first supporting portion 244 and the flexible circuit board 300 can be further limited in the second direction D2 and the third direction D3.

The second hook 708 is configured to latch the second supporting portion 242 of the base 702. However, the present disclosure is not limited thereto. In some embodiments, the second hook 708 is latched to the flexible circuit board 300. Accordingly, the second hook 708 limits the second supporting portion 242 and the flexible circuit board 300 in the second direction D2. Additionally, by a way that the two second through holes 2422 of the second supporting portion 242 and the two third through holes 3202 of the flexible circuit board 300 respectively position the two second protruding posts 224 of the base body 704 therein, and the second supporting portion 242 and the flexible circuit board 300 can be further limited in the first direction D1 and the third direction D3.

Also, different from the electrical connection device 100 in FIG. 1, the base 702 of the electrical connection device 701 has two first inserting holes 712 at each side. The two end portions 710 of one fixing member 70 are respectively inserted into the two first inserting holes 712 positioned at the same side, so as to fix the base 702 to the substrate 800.

Figure 19:
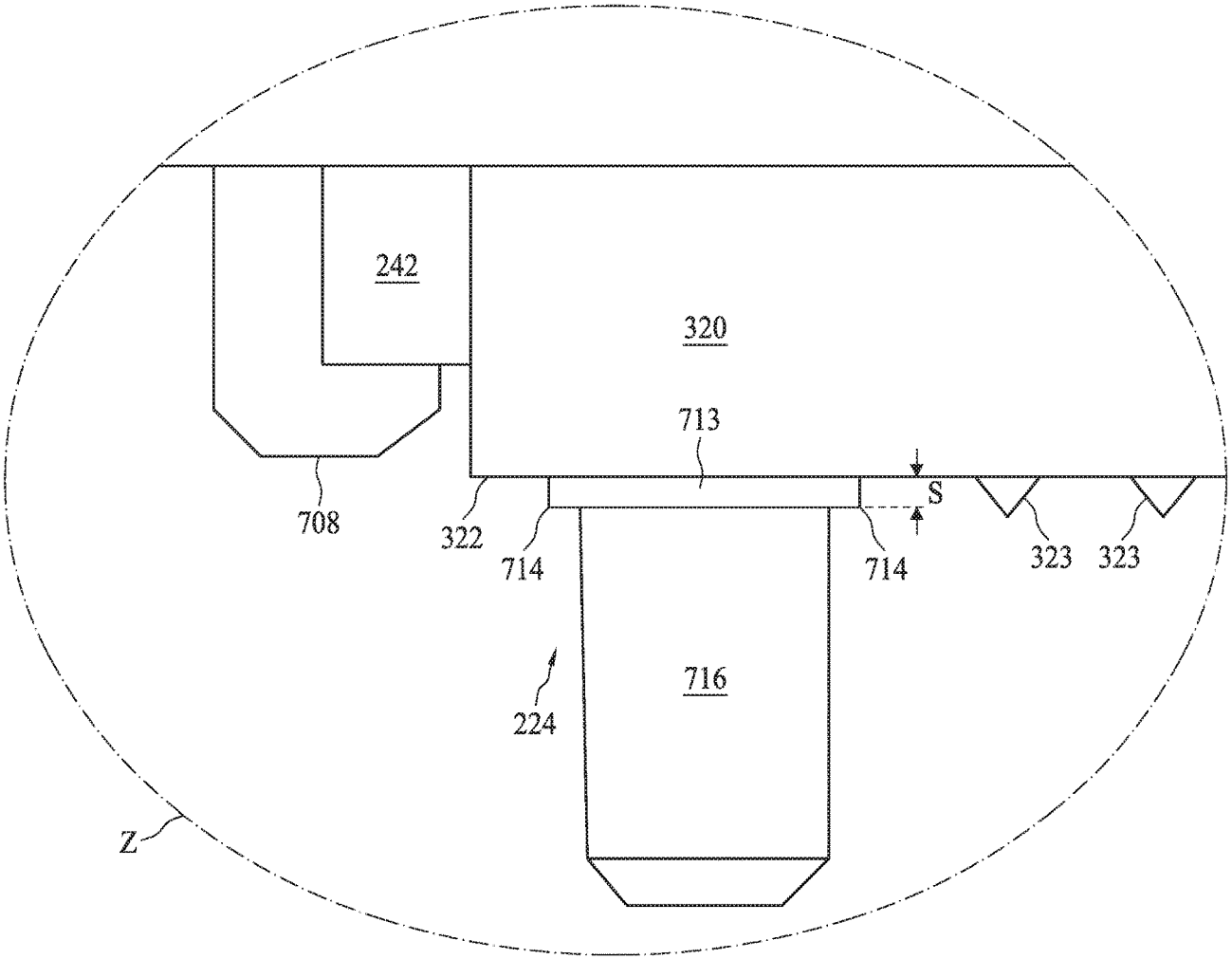
FIG. 19 is a partial enlarged view of an area Z in FIG. 18.

FIG. 19 is a partial enlarged view of an area Z in FIG. 18. Referring to FIG. 19, the two second protruding posts 224 each comprise a first body portion 713 and a second body portion 716.

The first body portion 713 is configured to form a gap between the substrate 800 and the mounting portion 320 of the flexible circuit board 300. Additionally, the first body portion 713 comprises a shoulder portion 714. The shoulder portion 714 is configured to abut against the substrate 800. Accordingly, a height of each of the plurality of conductive blocks 323 is defined by the shoulder portion 714, and essentially identical to each other. More specifically, the height of each of the plurality of conductive blocks 323 is essentially the same as the distance S from the shoulder portion 714 of the second protruding post 224 to the mounting surface 322 of the flexible circuit board 300. The shoulder portion 714 helps maintain consistency of the gap between the flexible circuit board 300 and the substrate 800, accuracy of the gap is thus relatively high, so as to achieve a consistent electrical performance.

The second body portion 716 is provided on the first body portion 713 and exposes the shoulder portion 714 of the first body portion 713. The second body portion 716 is configured to be positioned in the fourth through hole 824 of the substrate 800. In some embodiments, a radius of the second body portion 716 is smaller that a radius of the first body portion 713.

In the present disclosure, the shoulder portion 714 to abut against the substrate 800 is directly provided on the second protruding post 224, thus there is no need to increase additional components for raising. Therefore, the structure of the electrical connection device 701 in the present disclosure is simple and easy to be manufactured. In some embodiments, the second protruding post 224 of the electrical connection device 100 shown in FIG. 1 also has the shoulder portion 714.

In an embodiment of the present disclosure, the first terminals 440 of the first connector 400 and the second terminals 540 of the second connector 500 of the electrical connection device 100 are not directly connected with the substrate 800, but are connected with the substrate 800 through the first mating portion 310, the second mating portion 330, the first and second conductive traces 380,390 and the mounting portion 320 of the flexible circuit board 300. Compared with a conventional method that a grounding terminal is utilized to reduce a crosstalk between signal terminals, in the embodiment of the present disclosure, because an inherent grounding layer in the flexible circuit board 300 can provide a better ground reference and shielding to absorb an interference such as an electromagnetic wave with a wider range emitted from the first and second conductive traces 380,390 when transmitting signals, thus the crosstalk between the first and second conductive traces 380,390 can be better reduced. Additionally, an effect of utilizing the flexible circuit board 300 to reduce the crosstalk is not affected by the number of stacks of the connectors, thus the design of the electrical connection device 100 can be more flexible, for example, and more connectors can be further included.

In an embodiment of the present disclosure, the flexible circuit board 300 of the electrical connection device 100 is connected with the substrate 800 through the plurality of first conductive blocks 324 and the plurality of second conductive blocks 326. Compared with a conventional method that terminals is directly connected with the circuit board, in the embodiment, the plurality of first conductive blocks 324 and the plurality of second conductive blocks 326 can provide the better coplanarity when connected to the substrate 800 by a technology such as the surface-mount technology, so that the plurality of first conductive blocks 324 and the plurality of second conductive blocks 326 can be reliably mounted on correct positions of the substrate 800.

In the disclosure of the present specification, characteristics related to specific embodiments were described, as a result, a person of ordinary skill in the art may be more aware of the various aspects of the disclosure of the present application. The person of ordinary skill in the art should understand that the disclosure of the present application can be used easily to design or modify other processes and structures and to achieve the same purpose and/or to achieve the same advantages as detailed description of the present application. The person of ordinary skill in the art should also understand that the structures without departing from the spirit and scope of the disclosure of the present application, and could naturally devise other embodiments, modifications, and variations with reference to the disclosure of the present specification without departing from the spirit and scope of the disclosure of the present application.

What is claimed is:

1. An electrical connection device provided on a substrate, the electrical connection device comprising:

a base comprising:

a first supporting portion; and a second supporting portion;

a flexible circuit board comprising:

a first mating portion configured to be supported by the first supporting portion in a first direction, the first mating portion having a first mating surface, a plurality of first soldering pads being provided on the first mating surface;

a second mating portion configured to be supported by the first supporting portion in the first direction, the second mating portion having a second mating surface, a plurality of second soldering pads being provided on the second mating surface;

a mounting portion configured to be supported by the second supporting portion in a second direction, the first direction being different from the second direction, the mounting portion having a mounting surface, a plurality of first conductive blocks and a plurality of second conductive blocks being provided on the mounting surface;

a plurality of first conductive traces connecting the plurality of first soldering pads and the plurality of first conductive blocks; and a plurality of second conductive traces connecting the plurality of second soldering pads and the plurality of second conductive blocks;

a first connector engaged with the first mating portion along the first direction, the first connector comprising:

a first insulative housing; and a plurality of first terminals fixed to the first insulative housing, each first terminal comprising:

a first contacting portion; and a first soldering portion connected to the first soldering pad;

a second connector engaged with the second mating portion along the first direction, the second connector comprising:

a second insulative housing; and a plurality of second terminals fixed to the second insulative housing, each second terminal comprising:

a second contacting portion; and a second soldering portion connected to the second soldering pad; and a fixing member fixing the base on the substrate, wherein the base further comprises a base body, wherein the first supporting portion and the second supporting portion are independent from the base body.

2. The electrical connection device of claim 1, further comprising:

a cover engaged with the base along the first direction, the cover being defined with at least one opening to expose the first contacting portions and the second contacting portions, wherein the fixing member is configured to fix an assembly of the base and the cover.

3. The electrical connection device of claim 1, wherein the substrate has a plurality of third soldering pads and a plurality of fourth soldering pads, the plurality of third soldering pads connect with the plurality of first conductive blocks, the plurality of fourth soldering pads connect with the plurality of second conductive blocks.

4. The electrical connection device of claim 1, wherein the base further comprises at least one second protruding post extending along the second direction.

5. The electrical connection device of claim 2, wherein the base further comprises a first inserting hole, the cover further comprises a second inserting hole, the substrate further comprises two third inserting holes, two end portions of the fixing member respectively pass through the first inserting hole and the second inserting hole and are respectively inserted into and fixed to the two third inserting holes.

6. The electrical connection device of claim 2, wherein the at least one opening comprises a first opening and a second opening, the first opening exposes the first contacting portions, and the second opening exposes the second contacting portions.

7. The electrical connection device of claim 2, wherein the base further comprises a protruding block, the cover further comprises a latching portion, the latching portion is defined with a latching opening, and the protruding block is latched and fixed to the latching opening.

8. An electrical connection device provided on a substrate, the electrical connection device comprising:

a base comprising:

a first supporting portion; and a second supporting portion;

a flexible circuit board comprising:

a first mating portion configured to be supported by the first supporting portion in a first direction, the first mating portion having a first mating surface, a plurality of first soldering pads being provided on the first mating surface;

a second mating portion configured to be supported by the first supporting portion in the first direction, the second mating portion having a second mating surface, a plurality of second soldering pads being provided on the second mating surface;

a mounting portion configured to be supported by the second supporting portion in a second direction, the first direction being different from the second direction, the mounting portion having a mounting surface, a plurality of first conductive blocks and a plurality of second conductive blocks being provided on the mounting surface;

a plurality of first conductive traces connecting the plurality of first soldering pads and the plurality of first conductive blocks; and a plurality of second conductive traces connecting the plurality of second soldering pads and the plurality of second conductive blocks;

a first connector engaged with the first mating portion along the first direction, the first connector comprising:

a first insulative housing; and a plurality of first terminals fixed to the first insulative housing, each first terminal comprising:

a first contacting portion; and a first soldering portion connected to the first soldering pad;

a second connector engaged with the second mating portion along the first direction, the second connector comprising:

a second insulative housing; and a plurality of second terminals fixed to the second insulative housing, each second terminal comprising:

a second contacting portion; and a second soldering portion connected to the second soldering pad;

a fixing member fixing the base on the substrate; and a cover engaged with the base along the first direction, the cover being defined with at least one opening to expose the first contacting portions and the second contacting portions, wherein the fixing member is configured to fix an assembly of the base and the cover, and wherein the flexible circuit board further comprises a light pipe to guide a light emitted from a LED element mounted on the flexible circuit board, the cover further comprises a light hole, the light pipe passing through the light hole.

9. The electrical connection device of claim 1, wherein the base body further comprises at least one first protruding post extending along the first direction, wherein the first supporting portion further comprises at least one first through hole configured to position the at least one first protruding post therein.

10. The electrical connection device of claim 1, wherein the base body further comprises at least one second protruding post extending along the second direction, wherein the second supporting portion further comprises at least one second through hole configured to position the at least one second protruding post therein.

11. The electrical connection device of claim 1, wherein the first supporting portion is independent from the second supporting portion.

12. The electrical connection device of claim 1, wherein the first supporting portion and the second supporting portion are integrally formed.

13. The electrical connection device of claim 1, wherein the flexible circuit board further comprises a connecting portion connecting the first mating portion and the mounting portion, the first mating portion and the second mating portion are positioned at a first end of the flexible circuit board, the mounting portion is positioned at a second end of the flexible circuit board opposite to the first end, and the flexible circuit board surrounds and covers the base by the connecting portion.

14. The electrical connection device of claim 1, wherein the first mating portion and the second mating portion of the flexible circuit board are positioned at a first end of the flexible circuit board, the mounting portion is positioned at a second end of the flexible circuit board opposite to the first end, the mounting portion is firstly connected to the second mating portion and then connected to the first mating portion, and the flexible circuit board is a L-shape viewed from side.

15. The electrical connection device of claim 1, wherein the flexible circuit board further comprises a connecting portion connecting the first mating portion and the mounting portion, the first mating portion is positioned at a first end of the flexible circuit board, the second mating portion is positioned a second end of the flexible circuit board opposite to the first end, the mounting portion is positioned between the first mating portion and the second mating portion, and the flexible circuit board surrounds and covers the base by the connecting portion.

16. The electrical connection device of claim 1, wherein the plurality of first conductive blocks each comprise a solder ball, and the plurality of second conductive blocks each comprise a solder ball.

17. The electrical connection device of claim 4, wherein the two second protruding posts each comprise:

a first body portion configured to form a gap between the substrate and the mounting portion, the first body portion comprises:

a shoulder portion configured to abut against the substrate; and a second body portion, provided on the first body portion and exposing the shoulder portion of the first body portion, configured to be positioned in a through hole of the substrate.

18. The electrical connection device of claim 8, wherein the base further comprises a base body, wherein the base body, the first supporting portion and the second supporting portion are integrally formed.

19. An electrical connection device provided on a substrate, the electrical connection device comprising:

a base comprising:

a first supporting portion; and a second supporting portion;

a flexible circuit board comprising:

a first mating portion configured to be supported by the first supporting portion in a first direction, the first mating portion having a first mating surface, a plurality of first soldering pads being provided on the first mating surface;

a second mating portion configured to be supported by the first supporting portion in the first direction, the second mating portion having a second mating surface, a plurality of second soldering pads being provided on the second mating surface;

a mounting portion configured to be supported by the second supporting portion in a second direction, the first direction being different from the second direction, the mounting portion having a mounting surface, a plurality of first conductive blocks and a plurality of second conductive blocks being provided on the mounting surface;

a plurality of first conductive traces connecting the plurality of first soldering pads and the plurality of first conductive blocks; and a plurality of second conductive traces connecting the plurality of second soldering pads and the plurality of second conductive blocks;

a first connector engaged with the first mating portion along the first direction, the first connector comprising:

a first insulative housing; and a plurality of first terminals fixed to the first insulative housing, each first terminal comprising:

a first contacting portion; and a first soldering portion connected to the first soldering pad;

a second connector engaged with the second mating portion along the first direction, the second connector comprising:

a second insulative housing; and a plurality of second terminals fixed to the second insulative housing, each second terminal comprising:

a second contacting portion; and a second soldering portion connected to the second soldering pad; and a fixing member fixing the base on the substrate, wherein the base further comprises:

a base body arranged along the first direction with the first supporting portion, and arranged along the second direction with the second supporting portion, wherein the base body comprises:

a first hook configured to latch either the first supporting portion of the base or the flexible circuit board; and a second hook configured to latch either the second supporting portion of the base or the flexible circuit board.

* * * * *